US009253864B2

(12) United States Patent
Caiafa et al.

(10) Patent No.: US 9,253,864 B2
(45) Date of Patent: Feb. 2, 2016

(54) APPARATUS AND METHODS TO CONTROL AN ELECTRON BEAM OF AN X-RAY TUBE

(71) Applicant: General Electric Company, Schenectady, NY (US)

(72) Inventors: Antonio Caiafa, Albany, NY (US); Uwe Wiedmann, Clifton Park, NY (US); Philippe Ernest, Gif (FR); Georges William Baptiste, Buc (FR); Dominique Poincloux, Buc (FR); Yan Jiang, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 123 days.

(21) Appl. No.: 14/202,520

(22) Filed: Mar. 10, 2014

(65) Prior Publication Data

US 2015/0063546 A1 Mar. 5, 2015

Related U.S. Application Data

(60) Provisional application No. 61/872,271, filed on Aug. 30, 2013.

(51) Int. Cl.

| | |
|---|---|
| ***H05G 1/50*** | (2006.01) |
| ***H05G 1/30*** | (2006.01) |
| ***H05G 1/52*** | (2006.01) |
| ***H05G 1/58*** | (2006.01) |

(52) U.S. Cl.

CPC . *H05G 1/50* (2013.01); *H05G 1/52* (2013.01); *H05G 1/58* (2013.01)

(58) Field of Classification Search

CPC .... H02M 3/155; H02M 3/156; G01N 23/223; G05B 19/075; G05F 1/56; H01J 35/045; H01J 35/06; H05G 1/10; H05G 1/30; H05G 1/34; H05G 1/46; H05G 1/50; H05G 1/58

USPC ..... 378/110, 113, 102, 112, 122, 137, 138, 378/98.6; 315/219

See application file for complete search history.

(56) References Cited

U.S. PATENT DOCUMENTS

| | | | | | |
|---|---|---|---|---|---|
| 2,497,681 | A * | 2/1950 | Mayer | H03K 17/288 | 327/282 |
| 2,607,011 | A * | 8/1952 | Kalmon | G05F 1/462 | 315/106 |
| 3,434,040 | A * | 3/1969 | Schneider | G05B 19/075 | 315/241 R |
| 5,444,610 | A * | 8/1995 | Gaudreau | G05F 1/56 | 323/293 |
| 5,682,412 | A * | 10/1997 | Skillicorn | A61B 6/06 | 378/113 |
| 6,094,458 | A * | 7/2000 | Hellberg | H03F 3/24 | 341/143 |
| 7,154,100 | B2 * | 12/2006 | Spartiotis | G01T 1/17 | 250/370.13 |

(Continued)

*Primary Examiner* — David A Vanore
(74) *Attorney, Agent, or Firm* — Robert M. McCarthy

(57) ABSTRACT

Apparatus and methods to control an electron beam of an x-ray tube are provided. One apparatus includes at least one of (i) a first switching unit having a voltage source and a pair of switches connected in series and configured to switch between open and closed positions to change an output voltage to engage or bypass the voltage source or (ii) a second switching unit connected to a voltage source and having a first pair of switches connected in series and a second pair of switches connected in series, wherein the first and second pair of switches are connected in parallel, and wherein the first and second pairs of switches are configured to switch between open and closed position to change an output voltage generated from the voltage source. The first and second switching units are connected in series and a third switching unit provided that is amplitude controllable.

27 Claims, 18 Drawing Sheets

(56) References Cited

U.S. PATENT DOCUMENTS 7,233,645 B2 * 6/2007 Feda ..... G01N 23/223 378/102
8,340,250 B2 * 12/2012 Lemaitre ..... A61B 6/032 378/122
2006/0097180 A1 * 5/2006 Spartiotis ..... G01T 1/17 250/370.13
2015/0063546 A1 * 3/2015 Caiafa ..... H05G 1/50 378/113
2015/0207415 A1 * 7/2015 Caiafa ..... H02M 3/33507 363/21.02

* cited by examiner

APPARATUS AND METHODS TO CONTROL AN ELECTRON BEAM OF AN X-RAY TUBE

CROSS-REFERENCE TO RELATED APPLICATIONS

This application claims priority to and the benefit of the filing date of U.S. Provisional Application No. 61/872,271, filed on Aug. 30, 2013, entitled "Apparatus and Methods to Control an Electron Beam of an X-ray Tube," which is hereby incorporated by reference in its entirety.

BACKGROUND

X-ray tubes may be used in a variety of applications to scan objects and reconstruct one or more images of the object. For example, in computed tomography (CT) imaging systems an x-ray source emits a fan-shaped beam or a cone-shaped beam toward a subject or an object, such as a patient or a piece of luggage. The terms "subject" and "object" may be used to include anything that is capable of being imaged. The beam, after being attenuated by the subject, impinges upon an array of radiation detectors. The intensity of the attenuated beam radiation received at the detector array is typically dependent upon the attenuation of the x-ray beam by the subject. Each detector element of a detector array produces a separate electrical signal indicative of the attenuated beam received by each detector element. The electrical signals are transmitted to a data processing system for analysis. The data processing system processes the electrical signals to facilitate generation of an image.

In general, in CT systems, the x-ray source and the detector array are rotated about a gantry within an imaging plane and around the subject. Furthermore, the x-ray source generally includes an x-ray tube, which emits the x-ray beam at a focal point. Also, the x-ray detector or detector array in some systems includes a collimator for collimating x-ray beams received at the detector, a scintillator disposed adjacent to the collimator for converting x-rays to light energy, and photodiodes for receiving the light energy from the adjacent scintillator and producing electrical signals therefrom. In other systems, a direct conversion material, such as a semiconductor (e.g., Cadmium Zinc Telluride (CdZnTe)) may be used.

The x-ray tube may include an emitter from which an electron beam is emitted toward a target. The emitter may be configured as a cathode and the target as an anode, with the target at a substantially higher positive voltage (which may be at ground) than the emitter (which may be at a negative voltage). Electrons from the emitter may be formed into a beam and directed or focused by electrodes and/or magnets. In response to the electron beam impinging the target, the target emits x-rays. The emitter may contain a number of electrodes used to set the local electric field on the emitting structure.

The voltage supplied to the electrodes of the emitter may be controlled to adjust the intensity or energy of x-rays that are generated. In these systems, with respect to controlling the emitter, it is desirable to be able to produce fast transitions from low to high voltages, as well as to produce slow changing waveforms between two or more electrodes voltage values. Conventional control systems and methods may add complexity and size to the overall system, and may not be able to cover the full spectrum of waveform profiles requested.

BRIEF DESCRIPTION

In one embodiment, a system for controlling the electron beam in an x-ray source is provided. The system includes at least one of a (i) first switching unit having a voltage source and a pair of switches connected in series and configured to switch between open and closed positions to change an output voltage to engage or bypass the voltage source, or (ii) a second switching unit having a voltage source, and a first pair of switches connected in series and a second pair of switches connected in series, wherein the first and second pair of switches are connected in parallel, and wherein the first and second pairs of switches are configured to switch between open and closed position to engage or bypass the voltage source to an output voltage. The system also includes at least one of a third switching unit having a amplitude controllable voltage source with controllable amplitude, a first pair of switches connected in series and a second pair of switches connected in series, wherein the first and second pair of switches are connected in parallel, and wherein the first and second pairs of switches are configured to switch between open and closed positions to engage with positive sign, negative sign or bypass the amplitude controllable voltage source. The first, second, and third switching units are connected in series and the output voltages generated by the first, second and third switching units define a voltage profile for controlling the electron beam in an x-ray source.

In another embodiment, an x-ray tube assembly is provided that includes an emitter configured to emit an electron beam toward a target, and at least one of an emitter focusing electrode disposed proximate the emitter or an extraction electrode disposed proximate the emitter focusing electrode. The x-ray tube assembly also includes a controller configured to control a voltage supplied to at least one of the emitter focusing electrode and the extraction electrode. The controller includes at least one of (i) a first switching unit configured to discretely switch between a common voltage and a positive reference voltage, or (ii) a second switching unit configured to discretely switch between a common voltage, a positive reference voltage and a negative reference voltage, wherein output voltages generated by the first and second switching units define a voltage profile for controlling the voltage. The controller further includes at least one of a third switching unit having an amplitude controllable voltage source with controllable amplitude.

In a further embodiment, a method for controlling an x-ray tube is provided. The method includes connecting a plurality of switching units to a form a multi-stage controller, wherein the plurality of switching units include at least one discretely switched unit switching between one of a common voltage and at least one of a positive reference voltage or a negative reference voltage, and further including at least one amplitude-controllable unit switching within a voltage range. The method also including selectively controlling switches of the plurality of switching units to generate a varying voltage output profile including at least one of positive or negative voltage levels. The method further including applying the varying voltage output profile to one or more electrodes of an x-ray tube.

DETAILED DESCRIPTION

Figure 1:
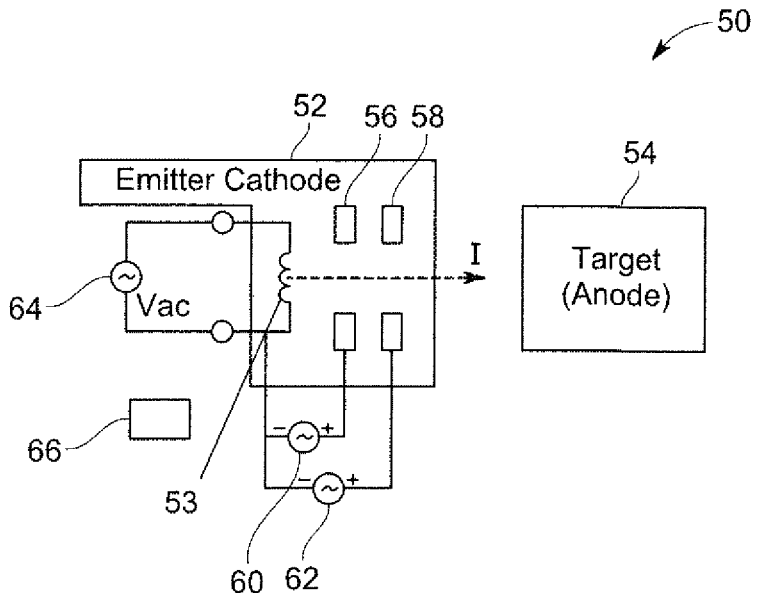
FIG. 1 is a simplified block diagram of an x-ray tube assembly in accordance with various embodiments.

Various embodiments will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., processors, controllers or memories) may be implemented in a single piece of hardware (e.g., a general purpose signal processor or random access memory, hard disk, or the like) or multiple pieces of hardware. Similarly, any programs may be stand-alone programs, may be incorporated as subroutines in an operating system, may be functions in an installed software package, and the like. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Methods and systems in accordance with various embodiments may generate voltage profiles that may be used to control an electron beam (e.g., control of intensity and/or energy) generated by an x-ray tube assembly. It should be noted that although various embodiments may be described in connection with an x-ray tube assembly having a particular configuration, other configurations, geometries and arrangements are contemplated. For example, various embodiments control the voltages on different electrodes of the x-ray tube assembly, which in some embodiments, includes an extraction electrode and a focusing electrode. The voltage may be controlled independently for each and float at a high voltage.

By practicing various embodiments and technical effects of various embodiments include providing extractor electronics for controlling the extraction electrode that are compact, provide high regulation and/or produce very fast transition from a low voltage (e.g., −2.5 kilovolts (kV) or less) to a high voltage (e.g., 6.5 kV or more) and/or slow changing waveforms (e.g., sinusoidal, trapezoidal or other waveforms) within two values, such as between −2.5 kV and 6.5 kV, or a combination of fast moving and slow moving waveforms Additionally, by practicing various embodiments, focus electronics for controlling the focusing electrode provide similar characteristics, as well as producing voltages between, for example, −2.5 kV and 12.5 kV. However, it should be noted that other voltage ranges may be provided as desired or needed. For example, the voltage range may extend higher or lower, such as between −3 kV and −12 kV.

FIG. 1 is a simplified block diagram of an x-ray tube assembly 50 formed in accordance with various embodiments. In the illustrated embodiment, the x-ray tube assembly includes an emitter cathode structure 52 (which may be, but is not limited to a Pierce Gun), which is the cathode and a target 54 that is the anode, both of which may be within a housing or casing of the x-ray tube assembly 50 as described in more detail herein. A voltage source 64 is provided in various embodiments that supplies a voltage to the emitter 53, which then may emit an electron beam as a result of being heated by the current supplied by the voltage source 64. It should be noted that different elements may be used instead of the voltage source 64, such as a current source or an indirectly heated emitter, among others. The electron beam may be directed towards the target 54 to produce x-rays, for example, by accelerating the electron beam from the emitter 53 towards the target 54 by applying a potential difference between the cathode structure 52 and the target 54. It should be noted that the target 54 may take different shapes and configurations as described in more detail herein.

The cathode structure 52 may also include an emitter focusing electrode 56, an extraction electrode 58, and optionally a downstream focusing electrode (not shown in FIG. 1). In the illustrated embodiments, the emitter focusing electrode 56 is disposed proximate the emitter 53 and the extraction electrode 58 is disposed downstream of the emitter focusing electrode 56 and the emitter 53, and the downstream focusing electrode (if provided) is disposed downstream of the extraction electrode 58, with the extraction electrode 58 thus interposed between the emitter focusing electrode 56 and the downstream focusing electrode 58. The electrodes may take different geometries or arrangements.

The voltage and current supplied to the emitter focusing electrode 56 and extraction electrode 58 are controlled in accordance with various embodiments. In various embodiments, the voltage and/or current supplied to the emitter focusing electrode 56 and extraction electrode 58 may be independently or separately controlled and allows for fast switching transitions or slow changing waveforms between different voltages. In the illustrated embodiment, a controller 66 is provided to control the voltage and/or current signals applied to the emitter focusing electrode 56 and/or extraction electrode 58 by the voltage sources 60 and 62. The controller 66 may control different circuits that provide for a cascading or multi-stage architecture or topology as described in more detail herein. Different types of stages also may be provided within a multi-stage topology to provide different control or operating characteristics for controlling the voltage and/or current supplied to the emitter focusing electrode 56 and/or extraction electrode 58. For example, the voltage potential at the emitter focusing electrode 56 and extraction electrode 58 may be maintained or varied based on a desired operating characteristic or mode of operation for the x-ray tube assembly 50. It should be noted that in various embodiments, the electronics and/or controls are located outside of the cathode structure 52.

Figure 2:
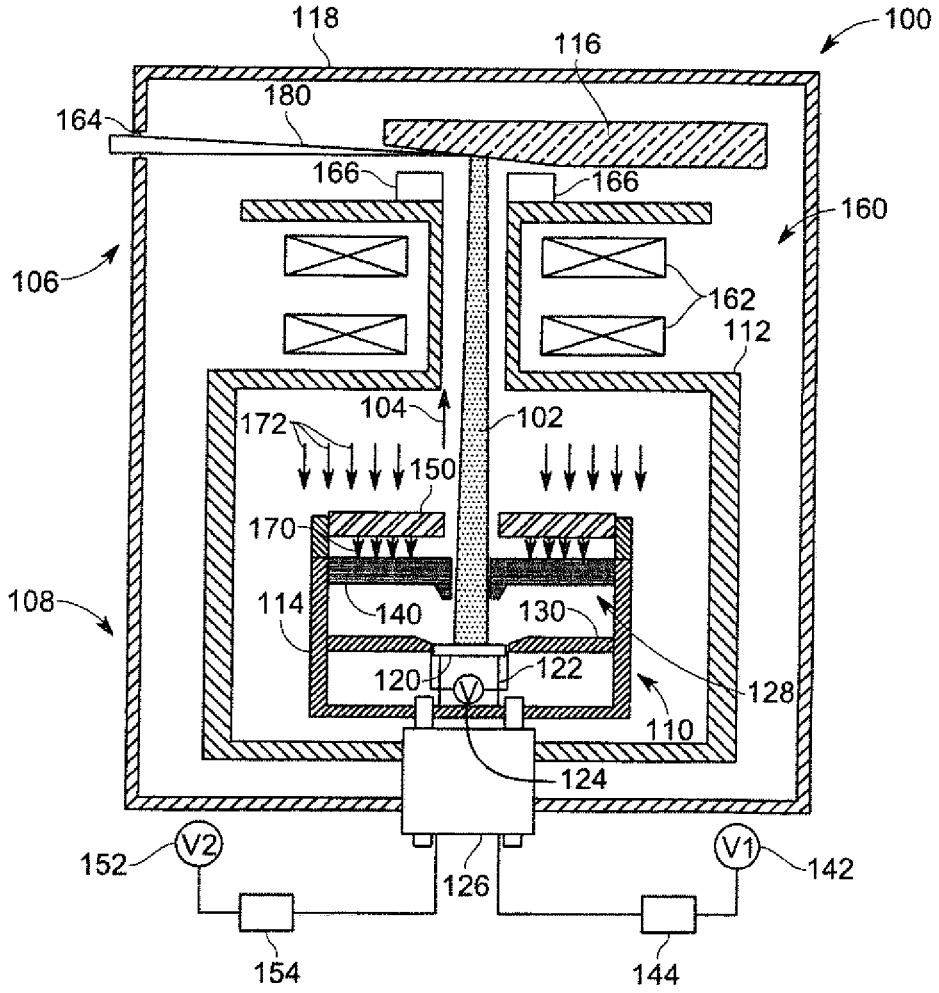
FIG. 2 is a sectional view of an x-ray tube assembly in accordance with various embodiments.

FIG. 2 is a sectional view of an x-ray tube assembly 100 formed in accordance with various embodiments. In one embodiment, the x-ray tube assembly 100 may be embodied as the x-ray tube assembly 50 shown in FIG. 1. However, in other embodiments, the x-ray tube assembly 100 is a different assembly. The x-ray tube assembly 100 includes an injector 110 (which includes the Pierce Gun structure in the illustrated embodiment, but may be separate therefrom or a different emitter cathode structure) disposed within a wall 112 that is within a vacuum wall 118. The injector 110 may further include an injector wall 114 that encloses various components of the injector 110. In addition, the x-ray tube assembly 100 may also include an anode or target 116. The anode 116 is typically an x-ray target. The injector 110 and the target 116 are disposed within a tube insert 118 (which may be within a larger casing with oil circulating therebetween for cooling). In some embodiments, the injector 110 may include at least one cathode in the form of an emitter 120. In some embodiments, the injector 110 may include a Pierce-type cathode or Pierce-like cathode geometry. The cathode (e.g., emitter 120) may be directly heated in some embodiments, and indirectly heated in some embodiments. In the illustrated embodiments, the emitter 120 is coupled to an emitter support 122, with the emitter support 122 in turn coupled to the injector wall 114. The emitter 120 may be heated, for example, by passing a relatively large current through the emitter 120. A voltage source 124 may supply this current to the emitter 120. In some embodiments, a current of about 10 amps may be passed through the emitter 120. The emitter 120 may emit an electron beam 102 as a result of being heated by the current supplied by the voltage source 124 and by applying an accelerating electric field from the voltage between the extraction electrode 140 and the emitter 120. As used herein, the term "electron beam" may be used to refer to as a stream of electrons that have substantially similar velocities. The electron beam 102 defines a downstream direction 104 as the direction from the emitter 120 to the target 116. In various embodiments, the injector wall 114 may be at or close to the emitter potential and the wall 112 is at or close to the target potential. In various embodiments, when the wall 112 is at the same voltage as the target 116, the wall 112 may be referred to as the anode to differentiate the structure from the target 116.

The x-ray assembly 100 includes a downstream end 106 and an upstream end 108, with the emitter 120 disposed proximate the upstream end 108 and the target 116 disposed proximate the downstream end 106. The electron beam 102 may have a substantially uniform width, diameter, or cross-section along one or more portions of the length of the electron beam 102. In practice, other profiles may be employed. For example, the electron beam 102 may have a relatively small, substantially continuous taper along the length of the electron beam 102. As another example, the electron beam 102 may be tapered at different rates along different portions of the length of the electron beam.

The electron beam 102 may be directed towards the target 116 to produce x-rays 180. More particularly, the electron beam 102 may be accelerated from the emitter 120 towards the target 116 by applying a potential difference between the emitter 120 and the extraction electrode 140. In some embodiments, a high voltage in a range from about 40 kV to about 450 kV may be applied via use of a high voltage feedthrough 126 to set up a potential difference between the emitter 120 and the target 116, thereby generating a high voltage main electric field 172 to accelerate the electrons in the electron beam 102 towards the target 116. In some embodiments, a high voltage potential difference of about 140 kV may be applied between the emitter 120 and the target 116. It may be noted that in some embodiments, the target 116 may be at ground potential. For example, in some embodiments, the emitter 120 may be at a potential of about −140 kV and the target 116 may be at ground potential or about zero volts.

In alternative embodiments, the emitter 120 may be maintained at ground potential and the target 116 may be maintained at a positive potential with respect to the emitter 120. By way of example, the target 116 may be at a potential of about 140 kV and the emitter 120 may be at ground potential or about zero volts. In some embodiments, a bi-polar target and emitter arrangement may be employed. For example, the emitter 120 may be maintained at a negative potential, the target 116 may be maintained at a positive potential, and a frame to which the emitter 120 and target 116 are secured may be grounded.

When the electron beam 102 impinges upon the target 116, a large amount of heat may be generated in the target 116. The heat generated in the target 116 may be significant enough to melt the target 116. In some embodiments, a rotating target may be used to address the problem of heat generation in the target 116. For example, in some embodiments, the target 116 may be configured to rotate such that the electron beam 102 striking the target 116 does not cause the target 116 to melt since the electron beam 102 does not strike the target 116 substantially continuously at the same location. In some embodiments, the target 116 may include a stationary target. The target 116 may be made of a material that is capable of withstanding the heat generated by the impact of the electron beam 102. For example, the target 116 may include materials such as, but not limited to, tungsten, molybdenum, or copper.

In the illustrated embodiment, the emitter 120 is a flat emitter. In alternative configurations the emitter 120 may be a curved emitter. The curved emitter, which is typically concave in curvature, provides pre-focusing of the electron beam. As used herein, the term "curved emitter" may be used to refer to an emitter that has a curved emission surface. Further, the term "flat emitter" may be used to refer to an emitter that has a flat emission surface. It may be noted that emitters of different shapes or sizes may be employed based on particular requirements for a given application.

In some embodiments, the emitter 120 may be formed from a low work-function material. More particularly, the emitter 120 may be formed from a material that has a high melting point and is capable of stable electron emission at high temperatures. The low work-function material may include materials such as, but not limited to, tungsten, thoriated tungsten, lanthanum hexaboride, hafnium carbide, or the like. In some embodiments, the emitter 120 may be provided with a coating of a low work-function material.

The injector 110 of the illustrated embodiments includes an electrode assembly 128 including an emitter focusing electrode 130 (which may be embodied as the emitter focusing electrode 56 of FIG. 1), an extraction electrode 140 (which may be embodied as the extraction electrode 58 of FIG. 1), and optionally a downstream focusing electrode 150. In the illustrated embodiments, the emitter focusing electrode 130 is disposed proximate the emitter 120, the extraction electrode 140 is disposed downstream of the emitter focusing electrode 130 and the emitter 120, and the downstream focusing electrode 150 is disposed downstream of the extraction electrode 140, with the extraction electrode 140 thus interposed between the emitter focusing electrode 130 and the downstream focusing electrode 150. The electrode assembly 128, or portions thereof, may be mounted to and/or enclosed by the injector wall 114. The particular geometries or arrangements of electrodes depicted in FIG. 2 are provided by way of example for simplicity and clarity of illustration and may differ in various embodiments. For example, one or more of the electrodes (e.g., the downstream focusing electrode) may have a larger outer diameter than other electrodes (e.g., the emitter focusing electrode and/or extraction electrode) and/or be mounted to an alternative wall or structure than injector wall 114. Also, one or more of the electrodes (e.g., the downstream focusing electrode) may have a greater length along an axis defined by the electron beam than other electrodes (e.g., the emitter focusing electrode and/or extraction electrode). Further, one or more of the electrodes may have a tapered bore, for example, a bore having a larger inner diameter at a downstream end and a smaller inner diameter at an upstream end.

The emitter focusing electrode 130 is disposed proximate to the emitter 120. In the illustrated embodiment, the emitter focusing electrode 130 is positioned such that at least a portion of the emitter focusing electrode 130 overlaps at least a portion of the emitter 120 in the downstream direction 104, with the portion of the emitter focusing electrode 130 that overlaps the emitter 120 disposed axially outward (with the electron beam 102 defining the axis) from the emitter 120 and surrounding the emitter 120 in the axial direction. In some embodiments, the emitter focusing electrode 130 may be disposed immediately downstream of the emitter 120 (e.g., not overlapping in the downstream direction, but either abutting or having a very small gap between the emitter 120 and the emitter focusing electrode 130 in the downstream direction 104). In some embodiments, the emitter focusing electrode is formed as a substantially continuous annular member (e.g., a ring).

In some embodiments, the emitter focusing electrode 130 may be maintained at a voltage potential that is less than a voltage potential of the emitter 120. The potential difference between the emitter 120 and the emitter focusing electrode 130 inhibits the movement of electrons generated from the emitter 120 from moving towards the emitter focusing electrode 130. For example, the emitter focusing electrode 130 may be maintained at a negative potential with respect to that of the emitter 120, with the negative potential with respect to the emitter 120 acting to focus the electron beam 102 away from the emitter focusing electrode 130, thereby facilitating focusing the electron beam 102 towards the target 116.

In some embodiments, the emitter focusing electrode 130 may be maintained at a voltage potential that is equal to or substantially similar to the voltage potential of the emitter 120. The similar voltage potential of the emitter focusing electrode 130 with respect to the voltage potential of the emitter 120 helps generate a substantially parallel electron beam by shaping electrostatic fields due the shape of the emitter focusing electrode 130. The emitter focusing electrode 130 may be maintained at a voltage potential that is equal to or substantially similar to the voltage potential of the emitter 120 via use of a lead (not shown in FIG. 3) that couples the emitter 120 and the emitter focusing electrode 130. Additionally or alternatively, the voltage potential of the emitter focusing electrode 130 may be adjustable between a potential substantially similar to the potential of the emitter 120 and a negative potential with respect to the potential of the emitter 120.

The electrode assembly 128 of the injector 110 further includes an extraction electrode 140 disposed proximate to and downstream of the emitter focusing electrode 130. The extraction electrode 140 is also disposed downstream of the emitter 120 and upstream with respect to the target 116, and is configured to additionally shape, control, and/or focus the electron beam 102 and an intensity thereof. In the illustrated embodiment, the extraction electrode 140 is formed as generally continuous ring shaped member disposed axially outwardly of the emitter 120 and the electron beam 102. In alternate embodiments, other shapes may be employed for the extraction electrode 140 (e.g., elliptical, polygonal, or the like).

In some embodiments, the extraction electrode 140 may be negatively biased with respect to the emitter 120. For example, a bias voltage power supply 142 may supply a voltage to the extraction electrode 140 (e.g., through the high voltage feedthrough 126) such that the extraction electrode 140 is maintained at a negative bias voltage with respect to the emitter 120. In some embodiments, the negative bias voltage may be variable. For example, the negative bias voltage may be variable between a maximum amplitude of negative bias voltage and a minimum amplitude of negative bias voltage. The minimum amplitude of negative bias voltage, in some embodiments, may be about zero volts of bias with respect to the voltage of the emitter 120. The bias voltage of the extraction electrode 140 may be adjusted via a control electronics module 144, which may control the bias voltage responsive to an operator input from, for example, an operator console.

Further, in some embodiments, the extraction electrode 140 may also be selectably positively biased with respect to the emitter 120. For example, the bias voltage power supply 142 may supply a voltage to the extraction electrode 140 such that the extraction electrode 140 is maintained at a positive bias voltage with respect to the emitter 120. The electrode assembly 128 may be configured so that an operator may selectably switch between a positive bias voltage and a negative bias voltage for the extraction electrode 140 (such as controlled by the controller 66 shown in FIG. 1). For example, a number of pre-set voltages may be selectable between a maximum negative bias voltage and a maximum positive voltage bias, or, as another example, the bias voltage may be substantially continuously adjustable between the maximum negative bias voltage and the maximum positive voltage bias (e.g., via use of a dial, slider, or the like on a control panel or operator console).

The electrode assembly 128 of the injector 110 further optionally includes a downstream focusing electrode 150 disposed proximate to and downstream of the extraction electrode 140. In the illustrated embodiment, one downstream focusing electrode 150 is shown. In some embodiments, additional downstream focusing electrodes may be employed. The downstream focusing electrode 150 is thus also disposed downstream of the emitter 120 and upstream with respect to the target 116, and is configured to additionally shape, control, and/or focus the electron beam 102, for example, as described in co-pending application Ser. No. 13/718,672, entitled "X-ray Tube With Adjustable Electron Beam", which is commonly owned.

In the illustrated embodiment, the downstream focusing electrode 150 is formed as generally continuous ring shaped member disposed axially outwardly of the emitter 120 and the electron beam 102. In alternate embodiments, other shapes may be employed for the downstream focusing electrode 150 (e.g., elliptical, polygonal, or the like).

The downstream focusing electrode 150 may be positively biased with respect to the emitter 120. It should be noted that in some embodiments the downstream focusing electrode 150 may additionally be configured to aid in extraction of the electron beam and thus may also be understood as or referred to as a downstream extraction electrode. For example, a bias voltage power supply 152 may supply a voltage to the downstream focusing electrode 150 (e.g., through the high voltage feedthrough 126) such that the extraction electrode 140 is maintained at a positive bias voltage with respect to the emitter 120. In some embodiments, the positive bias voltage may be variable. For example, the positive bias voltage may be variable between a maximum amplitude of positive bias voltage and a minimum amplitude of positive bias voltage. The bias voltage of the downstream focusing electrode 150 may be adjusted via a control electronics module 154 (which may be embodied as the controlled 66 shown in FIG. 1), which may control the bias voltage responsive to an operator input from, for example, an operator console. For example, a number of pre-set voltages may be selectable between the maximum positive bias voltage and the minimum positive voltage bias, or, as another example, the bias voltage may be substantially continuously adjustable between the maximum positive bias voltage and the minimum positive voltage bias (e.g., via use of a dial, slider, or the like on a control panel or operator console).

Various combinations of bias voltages and currents among the electrodes of the electrode assembly 128 and/or magnet voltage or current settings may be employed to control the electron beam 102, for example, control the shape and/or intensity distribution of the electron beam 102. In particular, different circuits that may be used to form a multi-stage control arrangement will now be described, which may be implemented as a multi-stage architecture or topology having voltage supplies (e.g., the voltage sources 60 and 62) controlled by the controller 66 shown in FIG. 1. The stages may be configured to change the voltage fast, such as sub-micron seconds, control the maximum voltage and/or control the shape of the waveforms used to apply the voltage to the emitter focusing electrode 130 and/or the extraction electrode 140. The stages may each be configured differently to allow switching at different speeds.

Figure 3:
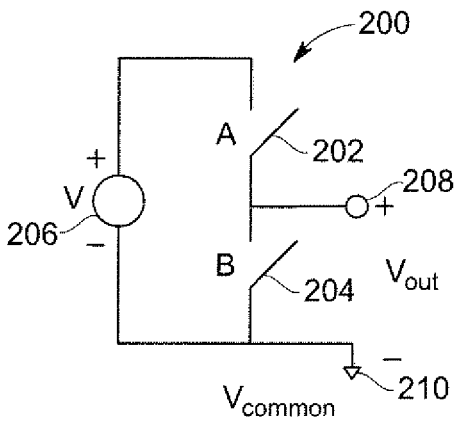
FIG. 3 is a schematic diagram of a switching unit in accordance with an embodiment.

For example, FIG. 3 illustrates a switching unit 200, which may be used to form a stage of a multi-stage architecture or topology. It should be noted that the switching units may be formed from different types of switching devices. In various embodiments, the switching devices are transistors, such as metal-oxide-semiconductor field-effect transistors (MOSFETs). However, any type of switching device may be used, such as an Insulated Gate Bipolar Transistor (IGBT), which may be formed from different materials, such as Silicon (Si), Silicon Carbide (SiC), Gallium Arsenide (GaAs), or any other material suitable to build such devices.

The switching unit 200 includes a pair of switches 202 and 204 (connected in series) that are each independently controllable to provide voltage switching from a reference voltage, illustrated as a voltage source 206. In this embodiment, the switch 202 is labeled switch A and the switch 204 is labeled switch B with the voltage output (Vout) 208 between the switches 202 and 204.

In operation, in various embodiments, one of the switches 202 and 204 is closed (Ruining a short in a closed state) and the other switch is open (in an open state). For example, if the switch 204 is closed and the switch 202 is open, Vout=Vcommon, which in various embodiments is zero volts (illustrated as ground 210 in FIG. 3). If the switch 204 is open and the switch 202 is closed, Vout=Vcommon+V.

Figure 4:
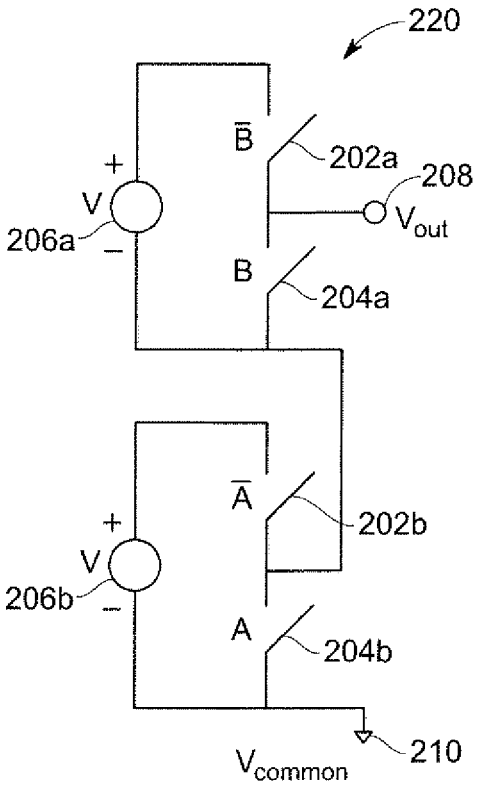
FIG. 4 is a schematic diagram illustrating a multi-stage topology using the switching unit shown in FIG. 3.

The switching units 200 may be combined or cascaded, for example, to form a multi-stage unit 220 shown in FIG. 4. It should be noted that like numerals represent like parts. Additionally, while FIG. 4 illustrates two stages, additional stages may be provided as described in more detail herein. It should be noted that for each of the switching units 200, during a particular state of operation, one of the switches 202 or 204 is open and the other switch 204 or 202 is closed.

In operation, if the switches 204*a* and 204*b* are closed (in which case the switches 202*a* and 202*b* are open), Vout=Vcommon. If the switch 204*b* is open and the switch 204*a* is closed (in which case the switch 204*a* is closed and the switch 204*b* is open), Vout=Vcommon+V. Similarly, if the switch 204*b* is closed and the switch 204*a* is open (in which case the switch 204*a* is open and the switch 204*b* is closed), Vout Vcommon+V. If both switches 204*a* and 204*b* are open (in which case both switches 202*a* and 202*b* are closed), Vout=Vcommon+V+V. Thus, in this operating state, the reference voltages from the two stages are summed. Accordingly, as more stages are added, incremental increases in output voltage are possible (e.g., discrete changes) by opening and closing the various switches in one or more of the stages. For example, if an output voltage (Vout) of 6 kV is desired, six switching units 200, each with a 1 kV reference voltage 206, may be connected similar to the arrangement shown in FIG. 4. Additionally, by the controlling the switches as described herein, incremental increases of 1 kV between 0 kV and 6 kV may be generated using 1 kV reference voltages 206. It should be noted that as a result of each switching unit 200 in this example having a reference voltage of 1 kV, the rating of the switches 202 and 204 can be 1 kV, instead of 6 kV, and still providing a maximum output voltage from the multi-stage arrangement of 6 kV. It also should be noted that the reference voltage at different stages may be different. For example, some stages may have a 1 kV reference voltage while other stages have a 2 kV reference voltage. Other reference voltage values may be provided, which may be non-integer values.

Figure 5:
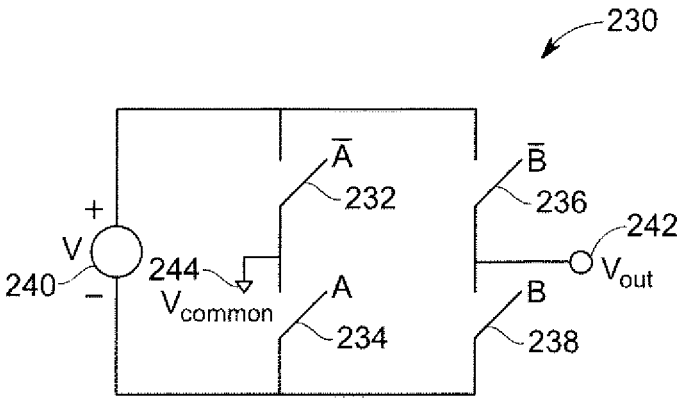
FIG. 5 is a schematic diagram of a switching unit in accordance with another embodiment.

The switching units 200 in various embodiments generally allow operation to switch positive or negative voltages depending on the polarity of one or more voltage sources 240 (as described in more detail herein), but not alternatively to a positive or negative voltage. Another switching unit 230 as shown in FIG. 5 is provided in some embodiments to allow operation to additionally switch alternatively to a positive or negative voltage. In particular, the switching unit 230 includes two pairs of serially connected switches in parallel connection, illustrated as switches 232 and 234 in parallel with switches 236 and 238. The switching unit 230 allows, for example, switching alternatively to either a positive or negative polarity using a single voltage source.

In operation, for each of the pairs of switches, when one of the switches is open, the other switch is closed. For example, if the switches 234 and 238 are closed (in which case the switches 232 and 236 are open), Vout Vcommon (in this example ground 244). Similarly, if the switches 232 and 236 are closed (in which case the switches 234 and 238 are open), Vout=Vcommon. However, if opposing switches, for example, the switches 232 and 236 or 234 and 238 are not similarly open or closed, different output voltages may be provided. In particular, if the switch 234 is closed and the switch 238 is open (in which case the switch 232 is open and the switch 236 is closed), Vout=Vcommon+V. Additionally, if the switch 234 is open and the switch 238 is closed (in which case the switch 232 is closed and the switch 236 is open), Vout=Vcommon−V. Thus, in operation, by controlling the switches in the switching unit 230, both negative and positive output voltages may be provided. Accordingly, in this example, using the switching unit 230, 0 volts, +V volts or −V volts may be applied, such as to the emitter focusing electrode 130 and/or the extraction electrode 140 (shown in FIG. 2).

Figure 6:
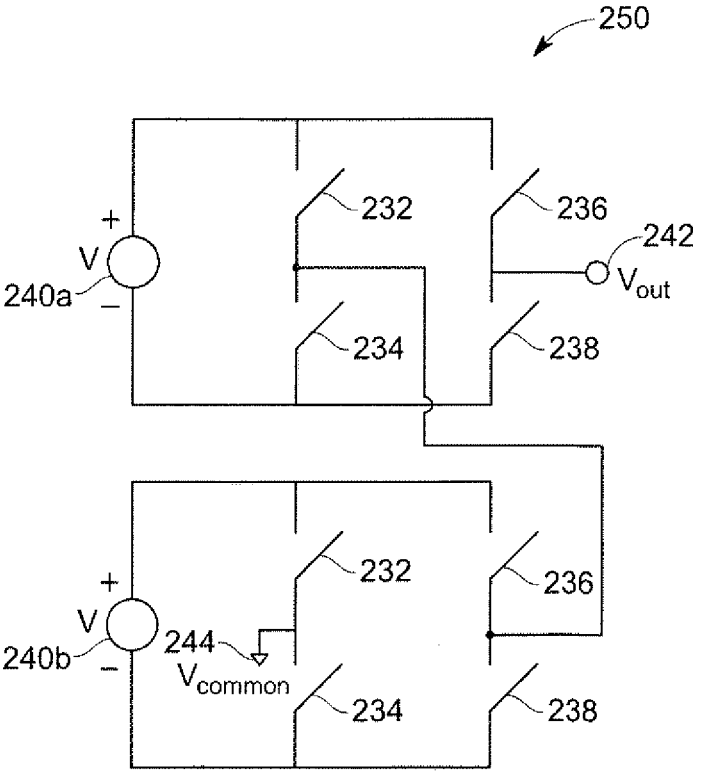
FIG. 6 is a schematic diagram illustrating a multi-stage topology using the switching unit shown in FIG. 5.

Similar to the switching unit 200, multiple switching units 230 may be combined or cascaded in a multi-stage architecture or topology. For example, as shown in FIG. 6, a multi-stage unit 250 may be formed from a plurality of switching units 230, illustrated as two switching units 230 connected in series. It should be noted that additional switching units 230 may be added. Also, it should be noted that the different stages may be connected in series or parallel. In the multi-stage unit 250 each switching unit 230 may provide 0 volts (or Vcommon), +V volts or V volts. Thus, similar to the multi-stage switching unit 220, an additive or summing voltage output mat be provided. For example, if the switch 234 is closed and the switch 238 is open in each stage (in which case the switch 232 is open and the switch 236 is closed in each stage), then Vout=Vcommon+V+V. Similarly, if the switch 234 is open and the switch 238 is closed in each stage (in which case the switch 232 is closed and the switch 236 is open in each stage), then Vout=Vcommon−V−V. Again, by adding more stages and/or changing the reference voltages, incremental output voltages may be provided.

In various embodiments, more switching units 200 than the switching units 230 are provided (e.g., the number of switching units 230 are limited or minimized) in a multi-stage architecture or topology to reduce or minimize the number of switches used. For example, in one embodiment, in order to provide a voltage operating range of −2 kV to +6 kV, four switching units 200 are connected with two switching units 230. In this configuration, discrete output voltage values may be provided within this kV range, for example, −2 kV, −1 kV, 0 kV, 1 kV, 2 kV, 3 kV, 4 kV, 5 kV and 6 kV. Thus, discrete voltage stepping may be provided. However, different voltage sources (reference voltages) may be used to provide different combinations and increments of voltage outputs. It should be noted that the embodiment described above includes 1 kV voltage sources 240, but other values may be used. Additionally it should be noted that in various embodiments different relationships between the values of the voltages sources 240 of each stage may be provided (e.g., a non-integer relationship between different voltage sources), therefore multistage combinations with voltage sources 240 of different values are also contemplated.

Variations and modifications are contemplated. For example, a voltage source may be provided that is controllable from 0V to 500V (and switched from positive to negative). The voltage source may be the voltage source 240 that is controlled between 0 V and +/−500 V. In this case, the voltage source can change smoothly (e.g., not incrementally, but continuously between 0 V and +/−500 V). When the continuously controllable voltage source Vm is coupled to an H-Bridge such as the one illustrated in FIG. 5, the unit can be controlled from the absolute value Vm connected negative (e.g. switch 232 and switch 238 are closed) to the absolute value of Vm connected positive (e.g. switch 234 and switch 236 are closed). It should be noted that the voltage orientation of this source (e.g. positive or negative) can be switched independently from the absolute value. Additionally, it should be noted that the voltage source Vm can be completely bypassed (e.g. by closing switches 234 and 238 concurrently). For example, the unit can change the output voltage Vout from −500 to +500 as follows: the source Vm is charged to 500V and the switches 232 and 238 closed (therefore switches 234 and 236 open) setting the output voltage Vout to −500V (assuming Vcommon=0). As the source Vm is discharged to any other value, for example 400V, the absolute value of the output voltage Vm is also discharged to the same value while the sign is set by the switch combination: in this example the output voltage is −400V. By linearly decreasing the voltage Vm from 500V to zero, the output voltage changes from −500V to 0V. As the voltage Vm reaches zero, the configuration of the bridge can be changed such that the switches 234 and 236 are now closed (and switches 232 and 238 are open) to directly connect the voltage Vm to the output voltage Vout. Now, by linearly increasing the voltage Vm from 0 to 500V, the output voltage also increases from 0 to +500V. Thus, the output voltage can be continuously changed from −500V to +500V. It should be noted that the voltage Vm, and therefore the output voltage Vout, can be continuously changed between 0V and a maximum value linearly or non-linearly.

In various embodiments, by linearly, non-linearly, or, generically non-discretely controlling the 500V source and switching on or off one or more of the switching units (also referred to as a bridge), the entire kV range may be controlled. For example, using a two 1 kV bridges (e.g., two switching units 230) and one continuously controllable 500 V source connected to an H-bridge such as the one illustrated in 230, a linear, non-linear or generally continuous control range may be provided. The voltage changes may be incremented as follows: −2.5 kV (−2 kV on and −500V) to −1.5 kV (−2 kV on and 500 V and then switching to −1 kV and −500V) to −0.5 kV (−1 kV and 500 V and then switching to 0 kV and −500 V) to 0.5 kV (0 kV and +500). The continuously changing output voltage is obtained by controlling the voltage Vm, and its associated bridge, as described herein. Thus, the output voltage can be controlled in the same manner up to +2.5 kV.

Figure 7:
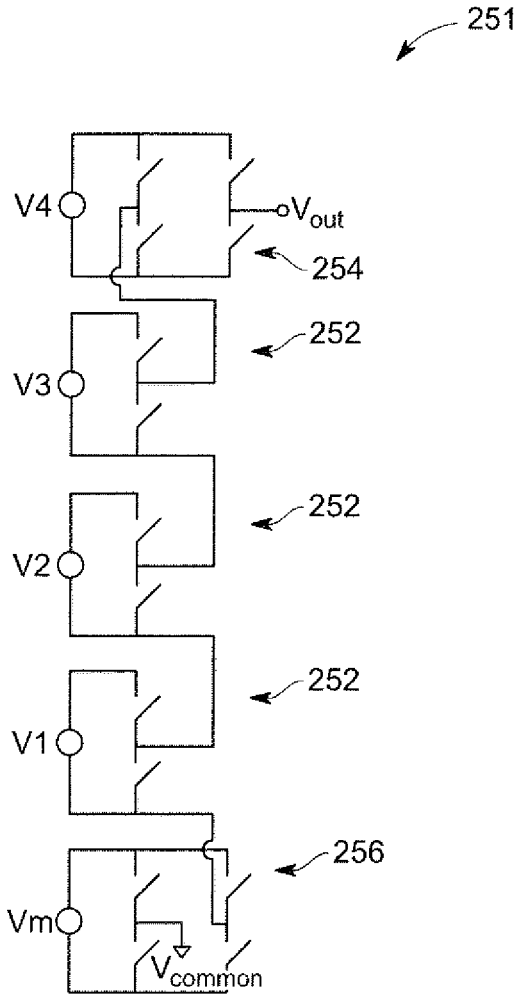
FIG. 7 is a schematic diagram of a multi-stage unit illustrating different switching units in accordance with an embodiment.

Thus, a non-discretely changing output voltage may be provided. For example, FIG. 7 illustrates a multi-stage unit 251 having three switching units 252, which may be embodied as the switching unit 200, a switching unit 254, which may be embodied as the switching unit 230, and a switching unit 256, which may be the non-discretely varying voltage (e.g., 0 V to 500 V), also referred to as a Vm switching unit. In this example, in operation, voltage switching from −1.5 kV to 4.5 kV may be provided by switching the polarity of the 500 V voltage source for the switching unit 256 if the other switching units have a 1 kV reference voltage.

Figure 8:
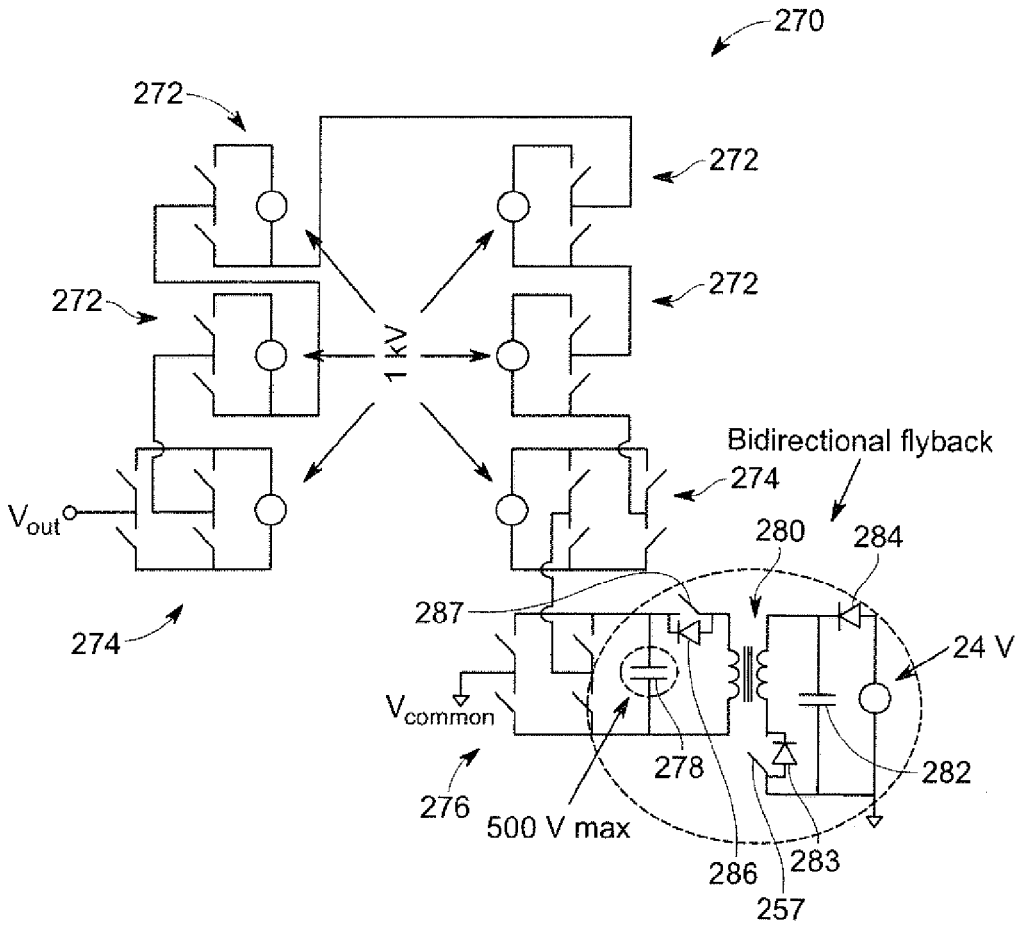
FIG. 8 is a schematic diagram of a multi-stage unit illustrating different switching units in accordance with another embodiment.

As another example, a multi-stage unit 270 shown in FIG. 8 may be provided, such as to control an extractor voltage as described herein, which in this embodiment is controllable in the voltage range of −2.5 kV to 6.5 kV, wherein four switching units 272 are 1 kV switching units (which may be embodied as the switching units 200), two switching units 274 are +/−1 kV switching units (which may be embodied as the switching units 230), and one switching unit 276 is a +/−500 V non-discretely varying switching unit. The switching units may be controlled as described in more detail herein. In this embodiment, a bidirectional flyback may be used to provide the continuously changing voltage in the unit Vm.

The bidirectional flyback has a capacitor 278 chargeable or dischargeable through a transformer 280 (which in various embodiments has primary and secondary windings in opposite directions). Similarly, on the opposite side of the transformer 280 is a capacitor 282 that is used to store or provide energy from and to the transformer 280. The capacitor 282 is connected through a diode 284 to a prime voltage source, illustrated as a 24 V source. Also, in this embodiment, the capacitor 278 has a maximum voltage of 1000V (500V being the maximum expected operational voltage). Thus, by charging and discharging the capacitor 278 to change the energy stored therein, the voltage of the non-discrete variable power supply is changed, which may be varied along a continuous range by adding or removing energy to the capacitor 278. In operation, an energy increase is achieved by using the switch 257. As the switch 257 closes, energy starts accumulating into the magnetizing inductance of the transformer 280. When the switch 257 opens, the accumulated energy is transferred to the capacitor 278 through the diode 286, thus increasing the energy, therefore the voltage of the capacitor 278. The amount of energy transfer is related to the amount of time the switch 257 stays in a closed state. The charge of the capacitor 278 to the desired voltage may be achieved in one or more switching periods of the switch 257.

Energy removal is achieved by using switch 287. As the switch 287 closes, energy starts to be transferred from the capacitor 278 into the transformer 280. When the switch 287 opens, the energy accumulated into the transformer 280 is transferred to the capacitance 282 through the diode 283, thus achieving energy recovery. The discharge of the capacitor 278 to the desired voltage may be achieved in one or more switching periods of the switch 287. It should be noted that the prime voltage source (here indicated as 24V) provides energy for the very first charging of the capacitor 282 and, during operation, provides only the energy lost during the charging and discharging of the capacitance 278.

Figure 9:
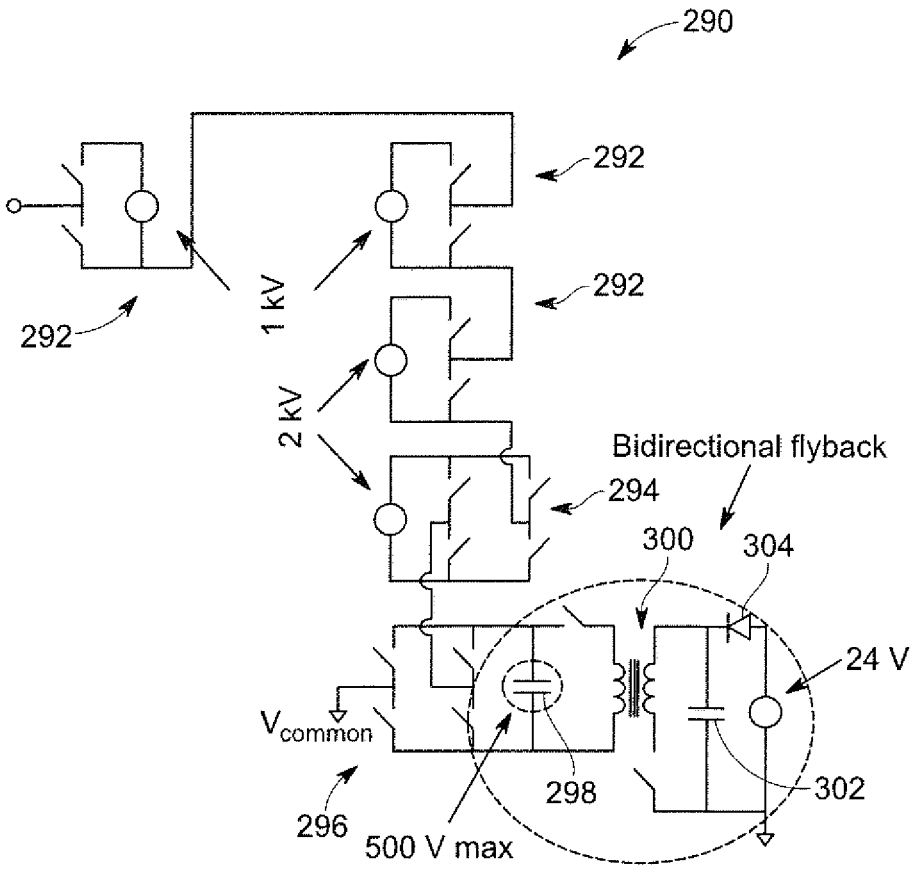
FIG. 9 is a schematic diagram of a multi-stage unit illustrating different switching units in accordance with another embodiment.

As another example, a multi-stage unit 290 shown in FIG. 9 may be provided, such as to control an extractor voltage as described herein, which in this embodiment is also controllable in the voltage range of −2.5 kV to 6.5 kV. However, in this embodiment, three switching units 292 are provided with two being 1 kV switching units and one being a 2 kV switching unit (which may be embodied as the switching units 200), one switching unit 294 is a +/−2 kV switching unit (which may be embodied as the switching unit 230), and one switching unit 296 is a +/−500 V non-discretely varying switching unit. The switching units may be controlled as described in more detail herein. In this embodiment, a bidirectional flyback may be used to provide the continuously changing voltage in the unit Vm. The bidirectional flyback has a capacitor 298 chargeable or dischargeable through a transformer 300. Similarly, on the opposite side of the transformer 300 is a capacitor 302 that is used to store or provide energy from and to the transformer 300. The capacitor 302 is connected through a diode 304 through a prime voltage source, illustrated as a 24 V source. Also, in this embodiment, the capacitor 298 has a maximum voltage of 1000V (500V being the maximum expected operational voltage). Thus, by charging and discharging the capacitor 298 to change the energy stored therein, the voltage of the non-discrete variable power supply is changed, which may be varied along a continuous range by adding or removing energy to the capacitor 298, as described in more detail herein.

Figure 10:
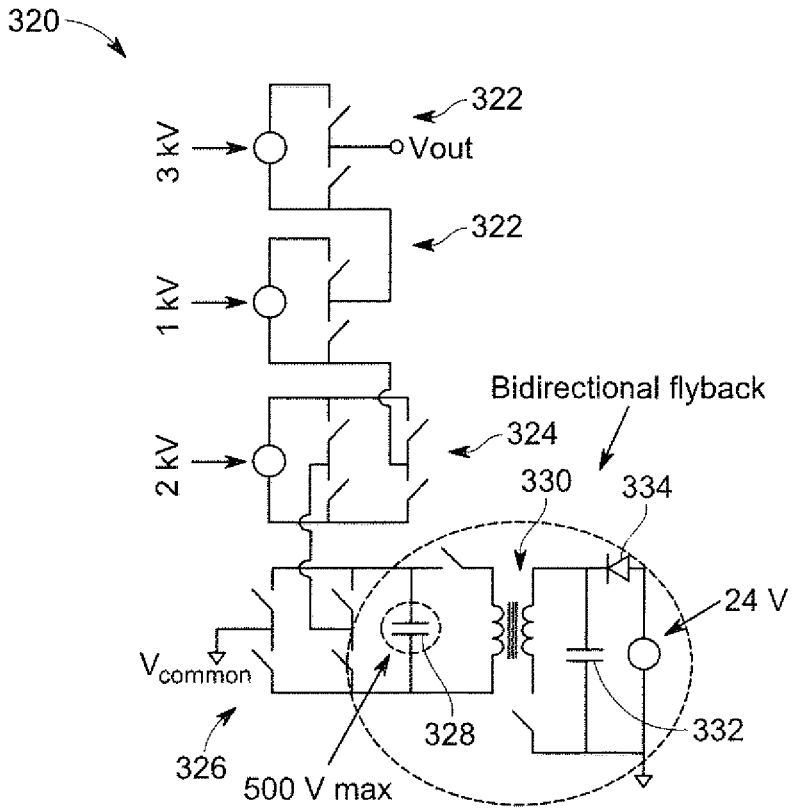
FIG. 10 is a schematic diagram of a multi-stage unit illustrating different switching units in accordance with another embodiment.

As still another example, a multi-stage unit 320 shown in FIG. 10 may be provided, such as to control an extractor voltage as described herein, which in this embodiment is also controllable in the voltage range of −2.5 kV to 6.5 kV. However, in this embodiment, two switching units 322 are provided with one being a 1 kV switching unit and one being a 3 kV switching unit (which may be embodied as the switching units 200), one switching unit 324 is a +/−2 kV switching unit (which may be embodied as the switching unit 230), and one switching unit 326 is a +/−500 V continuously varying switching unit. The switching units may be controlled as described in more detail herein. In this embodiment, a bidirectional flyback may be used to provide the continuously changing voltage in the unit Vm. The bidirectional flyback has a capacitor 328 chargeable or dischargeable through a transformer 320. Similarly, on the opposite side of the transformer 320 is a capacitor 332 that is used to store or provide energy from and to the transformer 320. The capacitor 332 is connected through a diode 334 to a prime voltage source, illustrated as a 24 V source. Also, in this embodiment, the capacitor 328 has a maximum voltage of 1000V (the maximum operative voltage being 500V). Thus, by charging and discharging the capacitor 328 to change the energy stored therein, the voltage of the non-discrete variable power supply is changed, which may be varied along a continuous range by adding or removing energy to the capacitor 328, as described in more detail herein.

Thus, in accordance with various embodiments, by changing the voltage of the non-discrete varying unit and switching (turning on and off) the switchable bridges (i.e., one or more discrete switching units), different voltage profiles may be generated. These voltage profiles can take any shape and the control is provided with very small or no filtering at all as only the voltage of the non-discrete varying source is being adjusted (versus switched).

Figure 11:
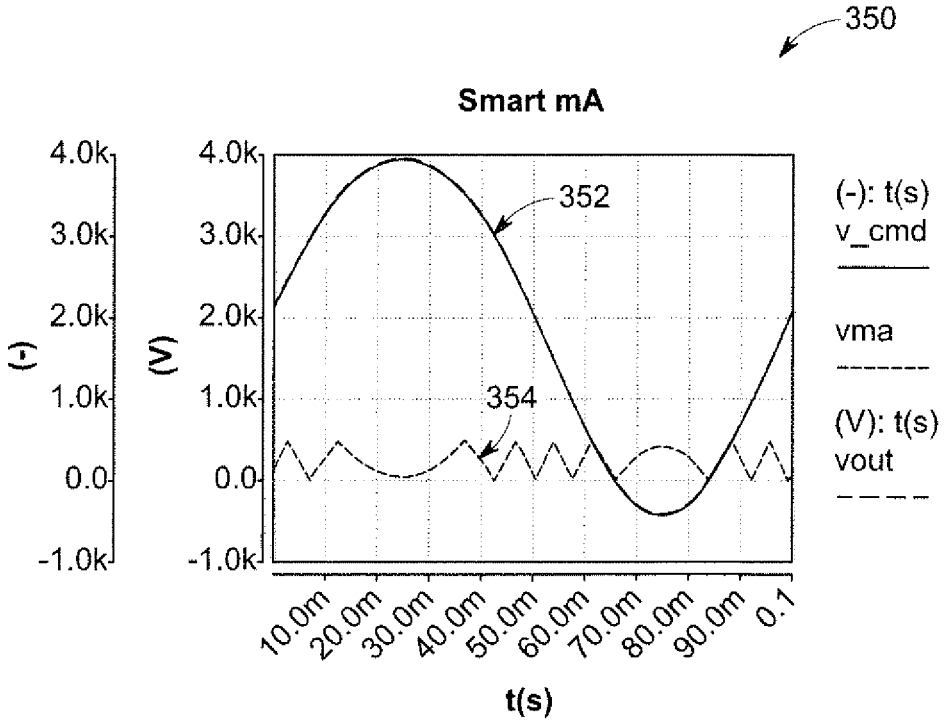
FIG. 11 is a graph illustrating an exemplary voltage profile generated in accordance with various embodiments.
Figure 12:
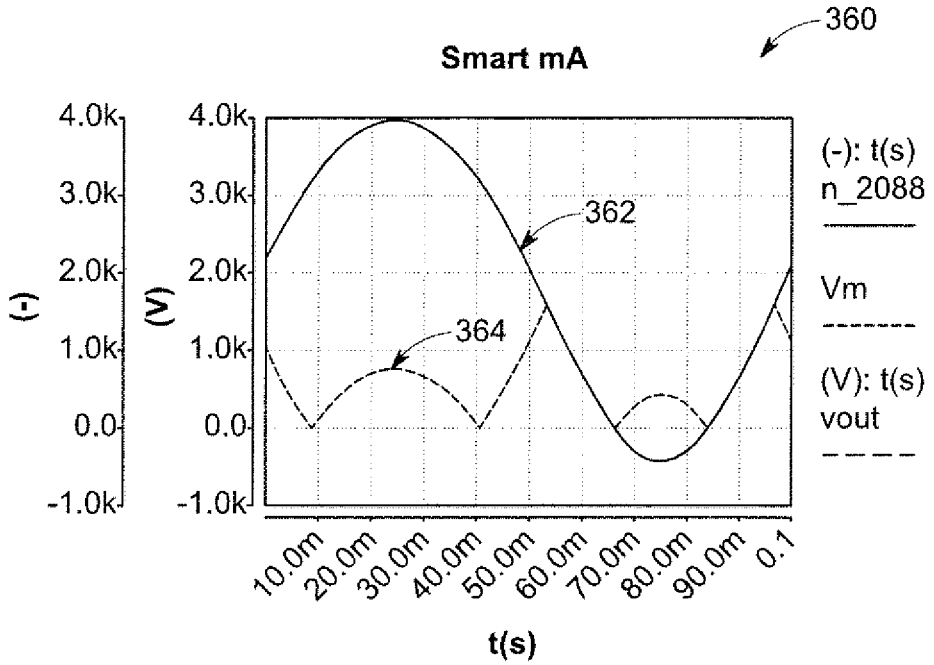
FIGS. 12-15 are graphs illustrating exemplary voltage profiles generated in accordance with various embodiments.
Figure 13:
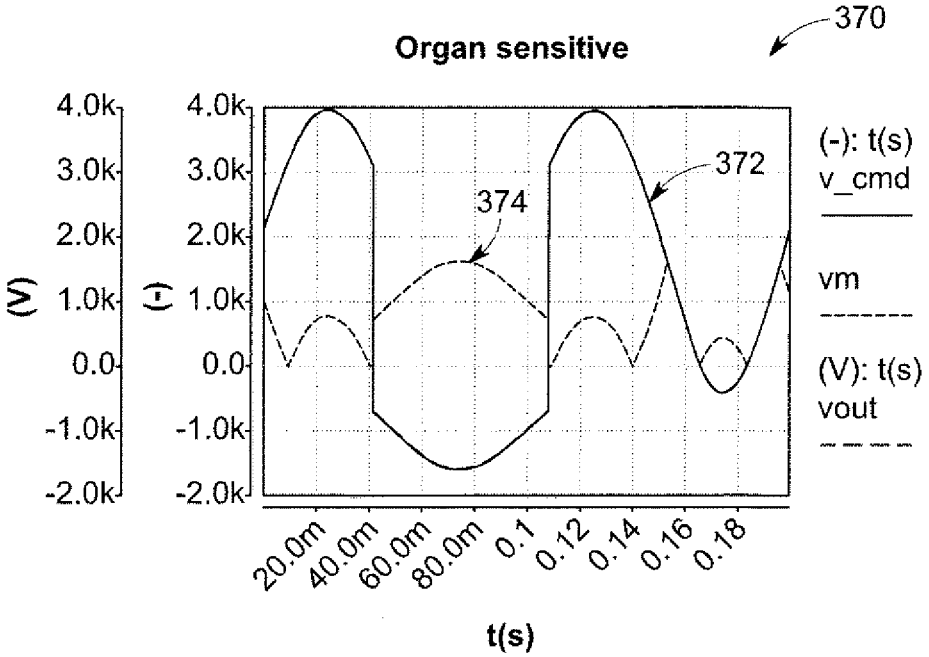

For example, the graph 350 of FIG. 11 illustrates a profile that may be generated using various embodiments. In particular, the curve 352 represents the output voltage (or control voltage), such as the waveform that can be used to control the voltage (and correspondingly the e-beam current (mA)), such as the extracting or focusing voltage level as described herein. The curve 354 represents the non-discrete varying voltage across the capacitor 278 (shown in FIG. 8), or capacitor 298 (shown in FIG. 9), or capacitor 328 (shown in FIG. 10). It should be noted that the curve 354 is independent from corresponding connection options (positive, negative, or bypassed), therefore the value thereof is always absolute. In particular, with respect to the circuit shown in FIG. 8, assume that two 1 kV bridges are activated such that the output voltage at time 0 is 2 kV. The varying voltage of the one stage (Vm stage) is then increased to 500 V, which causes the output voltage to increase from 2 kV to 2.5 kV, which increases continuously according to the desired shape, such as by charging a capacitor as described herein. The varying voltage is then switched to negative −500 V (by changing the configuration of its H-bridge switches), and another 1 kV bridge switched on (3 kV−500 V=2.5 kV) and then the non-discrete stage is discharged from −500V to 0V to increase the output voltage smoothly from 2.5 kV to 3 kV. This switching and voltage varying process may be repeated, for example, until the 4 kV output voltage is reached. It should be noted that the varying voltage may be increased or decreased over time at different rates to generate a corresponding output curve, for example, as can be seen, between about 4 and 8 milliseconds (ms) versus between about 13 and 25 ms.

As should be appreciated, any shape of output voltage profile may be generated. For example, the graphs 360, 370, 380 and 390 of FIGS. 12-15 illustrate different output voltage profiles illustrated by the curves 362, 372, 382 and 392 respectively that may be generated using, for example, one varying voltage stage and one or more switching stages. As can be seen in the graph 360, the varying voltage may be changed linearly or non-linearly as shown by the curve 364 to generate the generally sinusoidal output voltage curve 362. Additionally, the curve shown in the graph 360 illustrates an example where the bridge switchable voltage is 3 kV, instead of 1 kV, and the maximum Vm is 1.5 kV, instead of 500V. As another example, the voltage may be varied as shown by the curve 374 of the graph 370 to generate the voltage profile represented by the curve 372, which may be used, for example, to control an x-ray tube to perform organ sensitive imaging (e.g. higher voltage only when imaging region of interest). It should be noted that the example shown in the graph 370 illustrates an output voltage that includes both fast switching and continuous voltage control, which shows the flexibility that can be provided by such topology. Again, the curve shown in the graph 370 shows an example where the bridge switchable voltage is 3 kV, instead of 1 kV, and the maximum Vm is 1.5 kV, instead of 500V. As shown in the graph 380, fast switching of the varying voltage may be provided as illustrated by the curve 382 to provide, for example a fast switching mA for an x-ray tube. The graph 390 shows a generic PWM (pulse width modulation) combined with amplitude control that may be created and applied to the electrodes.

Figure 14:
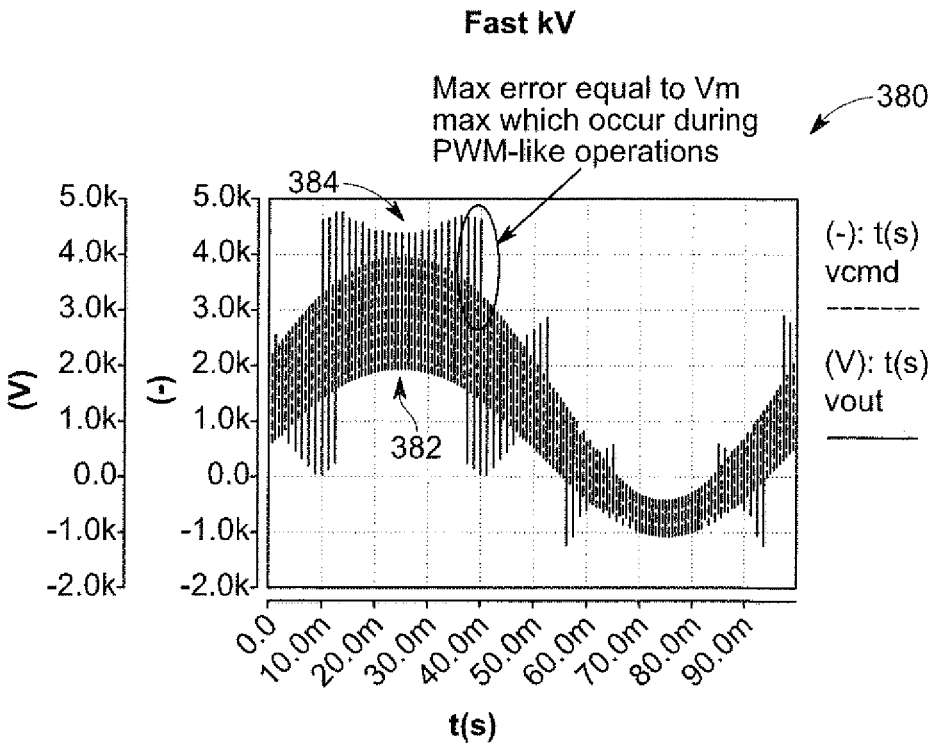
Figure 15:
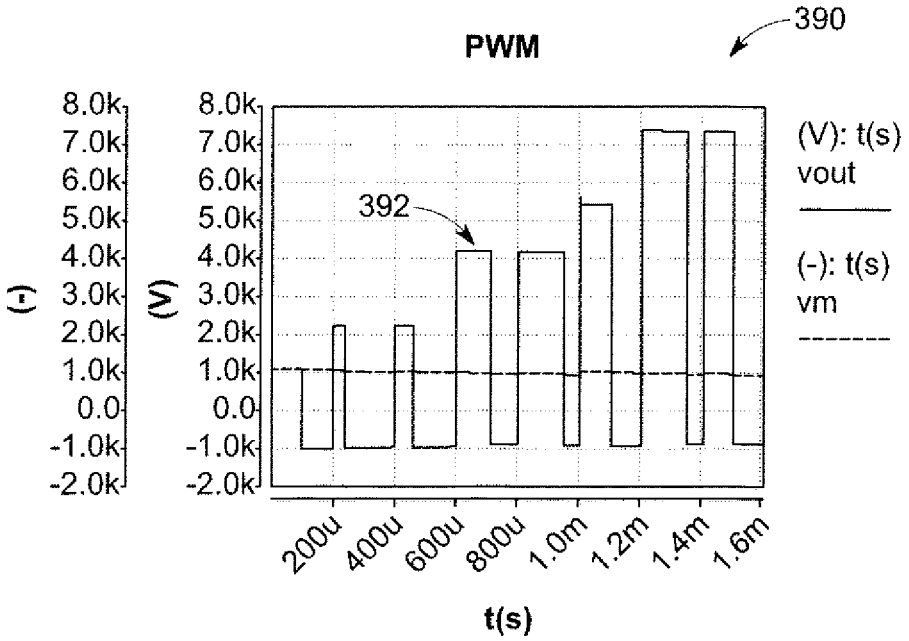

As can be seen in FIG. 14, when the output voltage has to quickly (e.g., in less than 10 uSec) switch between one value to another, and both these values are not achievable by switching the discrete units only, the output voltage exhibits an error that can be corrected within 20 to 30 uSec by adjusting the voltage on the capacitor 278 (shown in FIG. 8). The voltage adjustment may be performed while the capacitor 278 is already engaged to the output causing the above-described error. When the application requires minimal error, the overall circuit can include two Vm units (two units with continuously controllable voltage) as shown in FIG. 16.

Figure 16:
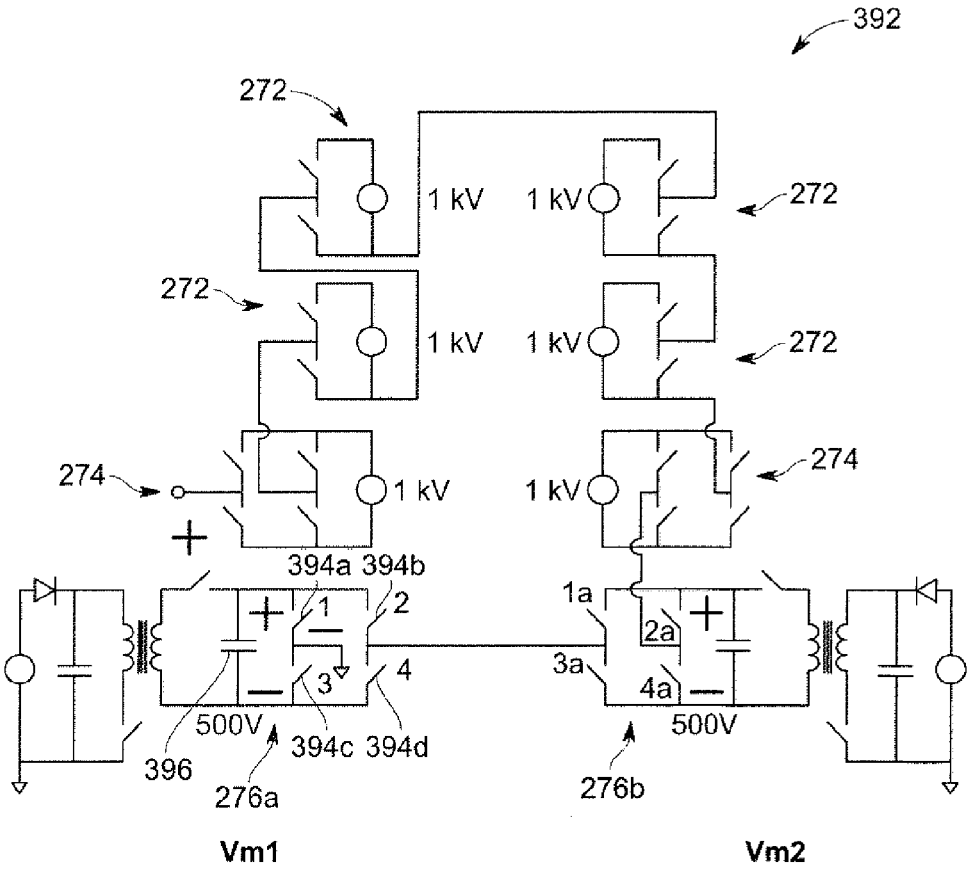
FIG. 16 is a schematic diagram of a multi-stage unit illustrating different switching units in accordance with another embodiment.

FIG. 16 shows a multi-stage unit 392 that may be provided, such as to control an extractor voltage as described herein, which in this embodiment is controllable in the voltage range of −2.5 kV to 6.5 kV, wherein four switching units 272 are 1 kV switching units (which may be embodied as the switching units 200), two switching units 274 are +/−1 kV switching units (which may be embodied as the switching units 230), and two switching unit 276 are a +/−500 V non-discretely varying switching unit. The switching units may be controlled as described in more detail herein. In this embodiment, one bidirectional flyback may be used to provide the continuously changing voltage in the unit Vm1 and a second bidirectional flyback may be used to provide the continuously changing voltage in the unit Vm2.

In operation, as the output voltage is set to operate to the desired voltage, and having one of the two switching units 276 charged to the desired value and engaged, the other switching unit is bypassed. For example, the unit 276*b* (Vm2) can be charged to the desired value and engaged, while the unit 276*a* (Vm1) can be bypassed by setting the switches 394*c* and 394*d* in a closed state, and the switches 394*a* and 394*b* in an open state (alternatively, unit 276*a* (Vm1) can be bypassed even if the switches 394*a* and 394*b* are in closed state and the switches 394*c* and 394*d* are in open state). While the unit 276*a* (Vm1) is bypassed, an output capacitor 396 can be charged to the next desired voltage level such that, when needed or desired, the capacitor 396 can be switched in place of the unit 276*b* (Vm2). Performing this operation provides that the output voltage can be switched extremely fast between any two values.

Figure 17:
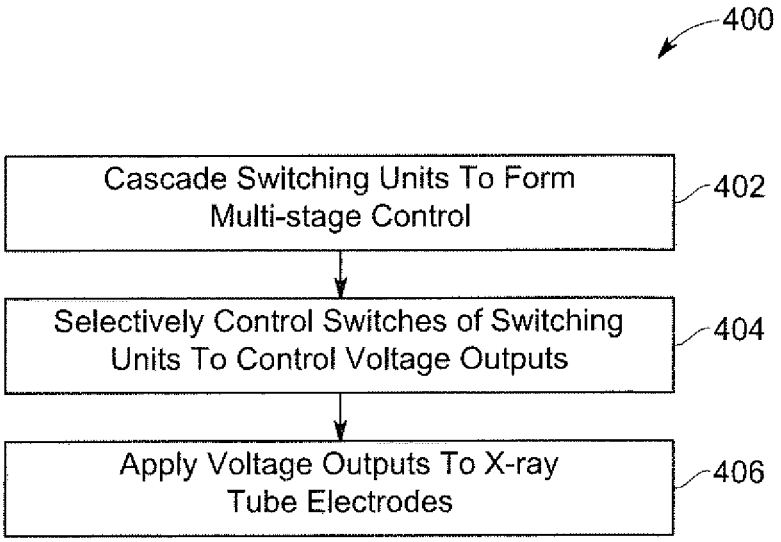
FIG. 17 is a flowchart of a method for controlling a voltage applied to an x-ray tube in accordance with various embodiments.

Thus, different control signal curves, such as varying voltage profiles may be generated to provide control in various embodiments. For example, various embodiments may control the number of stages that are turned on, as well as the manner in which the storage capacitor is charged or discharged (such as the capacitor 278 shown in FIG. 8). For example, various embodiments also provide a method 400 as shown in FIG. 17 to control the voltage of device, such as an x-ray tube. In particular, a plurality of switching units may be cascaded or combined to form a multi-stage control at 402 and as described in more detail herein. It should be noted that one, or more, of the stages may be a non-discretely varying voltage (Vm) stage. The method 400 also includes selectively controlling the multi-stage architecture or topology at 404. For example, selective control of switches within one or more switching stages and optionally in combination with controlling the varying voltage to control the voltage output(s) may be provided. For example, different output voltage waveforms may be generated. The method 400 also includes applying the voltage to a device, for example, electrodes of an x-ray tube as described herein to control the operation thereof, such as the electron beam intensity in an x-ray tube (e.g., a Pierce-like cathode geometry x-ray tube).

It should be noted there is no limit on the number of units that can be included in the multistage circuit. Moreover it should be noted that the only restriction on the maximum value of the continuously varying unit is that the unit in various embodiments cannot be smaller than half the value of the smallest voltage amplitude of the switching units. In various embodiments, the continuously varying unit has a value that is half of the smallest voltage amplitude of the switching units plus and additional amount to compensate for variances. For example, in one embodiment where 2 kV bridges (discretely switching unit) are provided, the continuously varying unit may have a value of 1.2 kV or 1.3 kV. Additionally, the power source or voltage for each stage may be the same or different.

Figure 18:
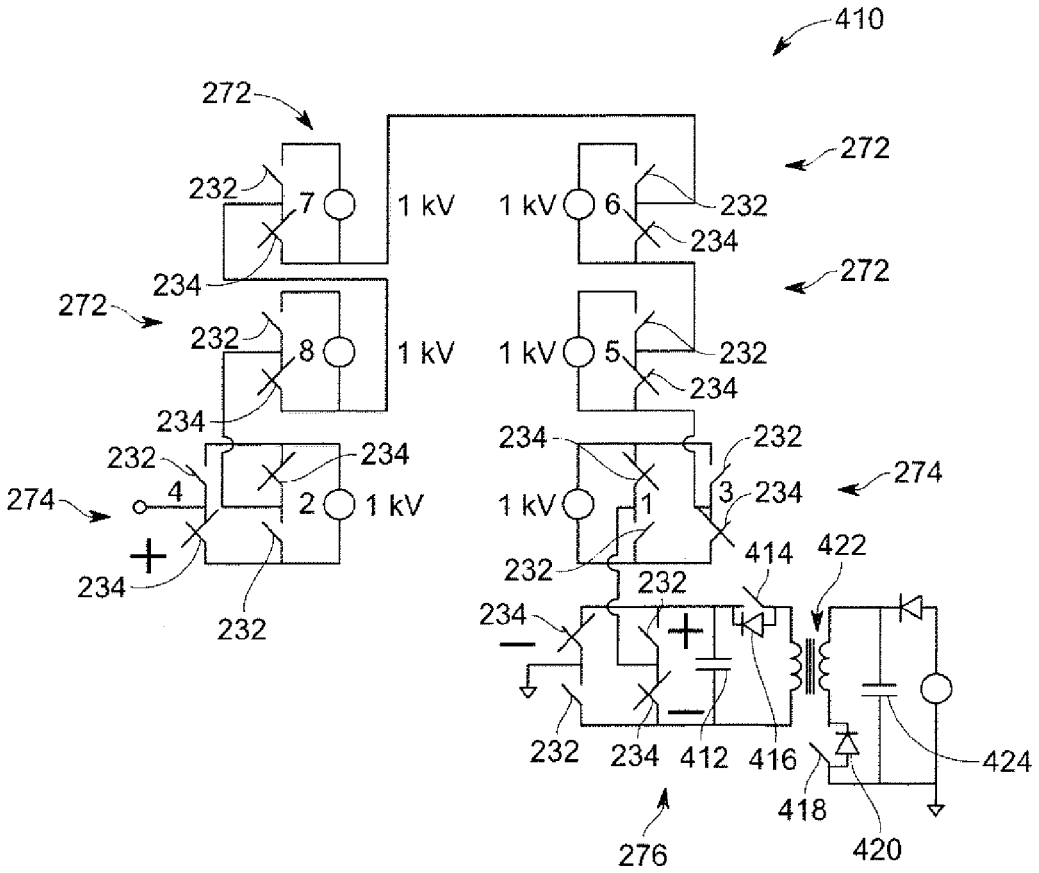
FIG. 18 is a schematic diagram of a multi-stage unit illustrating different switching units in accordance with another embodiment.
Figure 19:
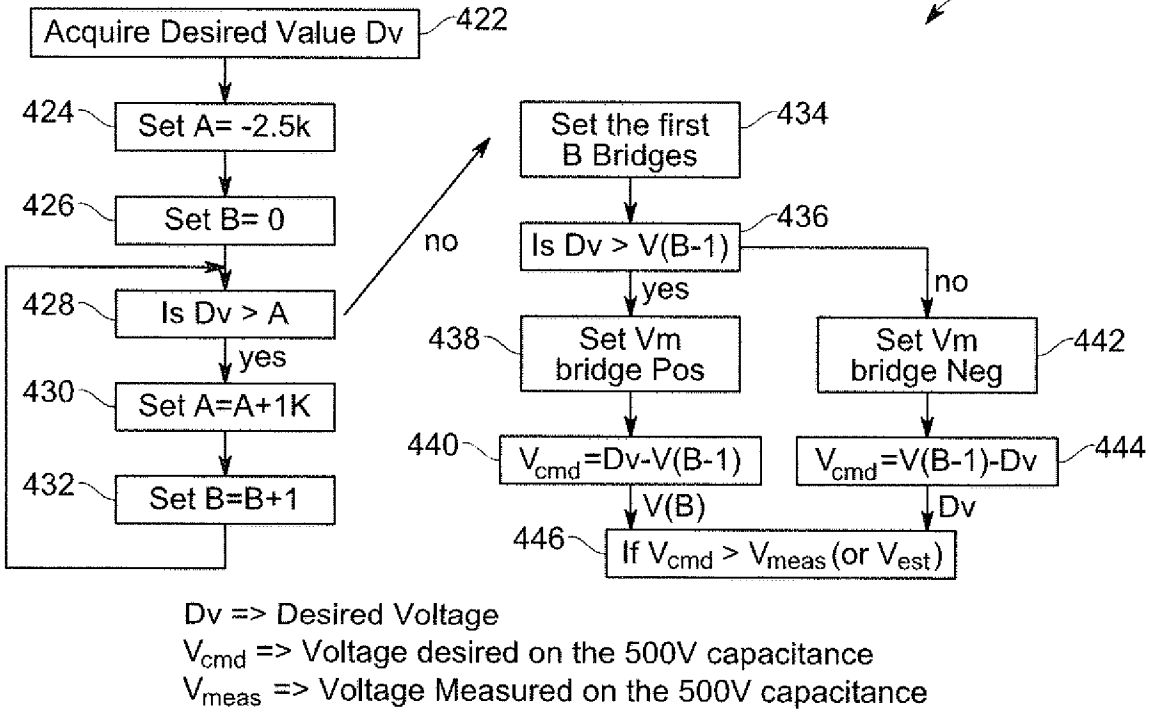
FIG. 19 is a flowchart of a method for an overall voltage control process in accordance with various embodiments.

A more detailed description of the control of various embodiments will now be provided with reference to FIG. 18 showing a multi-stage architecture 410 that provides a combination having a −2.5 kV output voltage if the switches 234 are closed (with the switches 232 open). In this operating state, none of the bridges formed from the switching units 272 are active. A method 420 for an overall control scheme is illustrated in FIG. 19. It should be noted that Dv is the Desired Total Output Voltage, Vcmd is the voltage desired on the capacitor 412 (500V capacitance) shown in FIG. 18, and Vmeas is the voltage measured on the capacitor 412. It should be noted that the control method described herein may be used to control, for example, the capacitor 278 (shown in FIG. 8), with a voltage controller, as known in the art, used to control the voltage to each of the bridges or stages. For example, the bridges or stages may be independently controlled (e.g., maintained at a constant voltage) with a separate control circuitry, such as a voltage controller and the capacitance for the continuously varying unit controlled as described herein. It should be noted that in various embodiments, while these controls are used in parallel, the controls do not interact or affect the other, such that these controls independently operate.

The method 420 shown in FIG. 19 includes acquiring a desired value for Dv at 422, which, for example, in the voltage value to be provided or replicated at the output of the multistage architecture 410. The value may be set by a user or predetermined or pre-defined. Thereafter, initialization steps 424 and 426 are performed, which in the illustrated embodiments, includes setting the initial voltage (represented by the variable A) to the value corresponding to off state; for example at −2.5 kV at 424 and setting the number of active gates (represented by the variable B) to zero at 426. It should be noted that these values may be changed or be different, such as based on the operating conditions or characteristics for the output voltage.

A determination is the made at 428 as to whether Dv is greater than A. If Dv is greater than A, then if the condition is true, at 430 A is incremented, for example, in this embodiment, A is set to A=A+1K (add output voltage) at 430 and B in incremented, for example, in this embodiment, B is set to B=B+1 (adding one active bridge as described herein to engage the corresponding voltage source). It should be noted that the output value added at 430 may be different, for example, based on the voltage for each stage (e.g., 500 V). A determination is then made again at 428 as to whether Dv is greater than A. This process or loop is repeated, for example, as many times as needed to invalidate the condition 428 or until the variable B is equal to the number of bridges (or discrete voltage levels) available in the circuit (if this process or algorithm is applied to the circuit shown in FIG. 18, the maximum number B can be is 8).

If a determination is first made at 428, or made after one or more iterations of steps 430 and 432, that Dv is not greater than A (e.g., less than A), then one or more bridges are set active at 434 and a determination is made at 436 as to whether Dv is greater than V(B), and the sum of discrete step voltages applied, which may be in increments of 1 kV starting from −2 kV. If Dv is greater than V(B), then at 438, the Vm bridge is set to apply a positive Vcmd voltage at 438 such that Vcmd=Dv−V(B−1) at 440. If Dv is not greater than V(B), then at 442, the Vm bridge is set to apply a negative Vcmd voltage at 442 such that Vcmd=V(B−1)−Dv at 444. Thus, for example if the total desired value Dv is 1.25 kV, the variable A will be set to A=2K, the variable B will be set to B=4, then V(B−1)=1 kV, and therefore the bridge Vm will be set to positive and $V_{cmd}$ will be set to $V_{cmd}$=0.25 kV. The next steps in the control will determine if the capacitance 412 needs to be charged to 250V or discharged to 250V.

Figure 20:
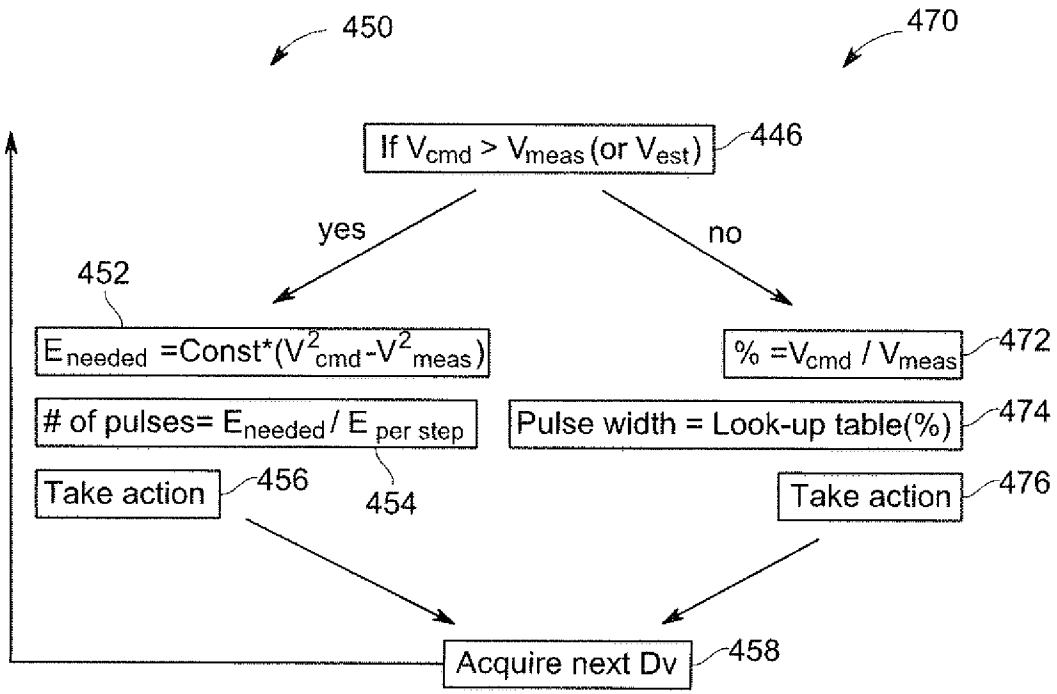
FIG. 20 is a flowchart of a voltage charging and discharging process in accordance with various embodiments.

A determination is then made at 446 as to whether $V_{cmd}$ is greater than $V_{meas}$. $V_{meas}$ is the voltage measured across the capacitance 412 in FIG. 18 by means of a voltage feedback circuit. If $V_{cmd}$ is greater than $V_{meas}$, then a charge method 450 is performed as shown in FIG. 20. If $V_{cmd}$ is not greater than $V_{meas}$, then a discharge method 470 is performed as shown in FIG. 20.

It should be noted that the voltage value across the capacitor 412 in FIG. 18 may be estimated, for example, through modeling or predictive algorithms. In this case a determination is then made at 446 as to whether $V_{cmd}$ is greater than $V_{est}$, with $V_{est}$ being the estimated (or predicted) voltage across capacitance 412. If $V_{cmd}$ is greater than $V_{est}$, then a charge method 450 is performed as shown in FIG. 20. If $V_{cmd}$ is not greater than $V_{est}$, then a discharge method 470 is performed as shown in FIG. 20.

More particularly, and as shown in FIG. 20, if $V_{cmd}$ is greater than $V_{meas}$ or $V_{est}$ the additional energy that must be supplied to the capacitance 412 is calculated at 452 as follows: $E_{needed}$=Const*($V_{cmd}^2$−$V_{meas}^2$) where the constant "Const" is proportional to the value of the capacitance that needs to be charged. The $E_{needed}$ is provided by operating the switch 418 in FIG. 18 in a pulsed fashion or manner. Each pulse is defined as closing a switch 418, keeping the switch 418 closed for an amount of time referred to as a "standard duration" and opening the switch 418. When the switch 418 is closed, the transformer 422 accumulates energy and when the switch 418 opens, the transformer 422 releases the accumulated energy into capacitor 412 through the diode 416. The energy that is accumulated then released in the pulse of standard duration is defined as $E_{per\ step}$. A determination of the number of pulses needed is made at 454 as follows: Number of Pulses=$E_{needed}/E_{per\ step}$. It should be noted that if the result of the aforementioned division is not an integer, the last pulse applied by the control will be a fraction of the standard pulse. For example, if step 454 gives as a result 4.61 then the control will apply 4 consecutive pulses of standard duration plus a fifth pulse of duration equal to 61% of the standard duration. Thereafter, the number of pulses is applied at 456 and the next Dv is acquired at 458. For example, if $V_{emd}$ is 250V and $V_{meas}$ (or $V_{est}$) is 50V, assuming that $E_{needed}$ is 5000 and $E_{per\ step}$ is 2000, then the switch 418 (shown in FIG. 18) must be operated such that two standard duration pulses, plus a third pulse equal to 50% of the duration of a standard pulse, are generated.

As shown in FIG. 20, if $V_{emd}$ is not greater than $V_{meas}$ (or $V_{est}$), then a percentage value is determined at 477 as %=$V_{cmd}/V_{meas}$. Then, the pulse width is determined at 474 using a look-up table. For example, based on the determined percentage at 472, a predetermined or predefined pulse width (e.g., determined from empirical or experimental data) is determined. The pulse width determined at 474 defines how long, for example, the switch 414 (shown in FIG. 18) is closed and the energy transferred to the transformer 422 and into the capacitor 424 (shown in FIG. 18) through the diode 420. The pulse width is then applied at 476 and the next Dv is acquired at 478. This process discharges the capacitor 412 to the desired value in a single pulse and recovers all or part of the removed energy into the capacitor 424. For example, if $V_{cmd}$ is 250V and $V_{meas}$ (or $V_{est}$) is 350V, then the switch 414 (in FIG. 18) is closed for the duration indicated in the look-up table 474. The energy removed will be returned to capacitor 424 (in FIG. 18) through the transformer 422 and diode 420 upon opening of the switch 414. It should be noted that the pulse width may be varying, for example, starting with longer pulses and reducing the length as the target value is approached. It also should be noted that in various embodiments a multi-dimensional look-up table may be used, for example, a two-dimensional look-up table as a function for both %=$V_{cmd}/V_{meas}$ and $V_{meas}$.

Alternatively, the look-up table in FIG. 20 step 474 may be replaced by a different look-up table that contains the pulse widths to reach the desired voltage value in two or more pulses. Such a solution may be used if total discharge time is not of great importance and if most of the energy needs to be recovered. The multiple pulses will be applied in step 476. In case of multiple pulses the energy removed from capacitor 412 will be returned to capacitor 424 in multiple steps.

Figure 21:
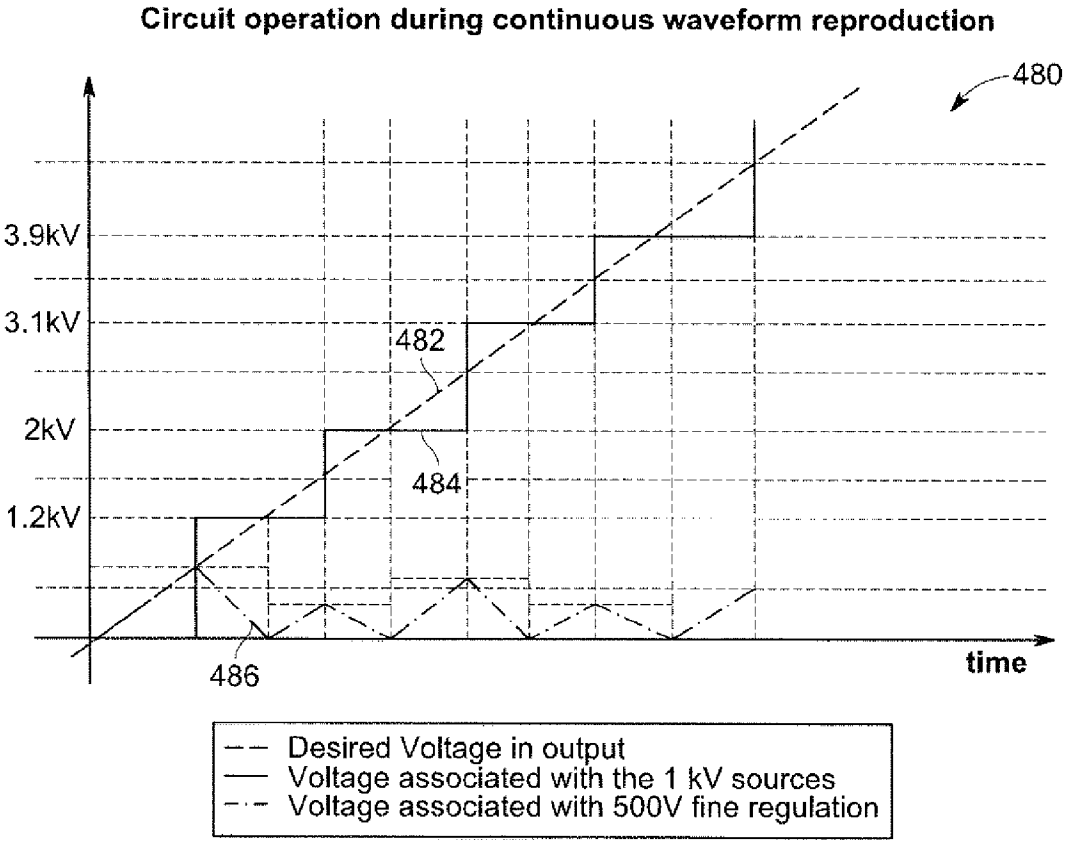
FIG. 21 is a graph illustrating different voltage curves in accordance with various embodiments.

Thus, for example, as shown in the graph 480 of FIG. 21, a desired output voltage is represented by the line 482, which is generated with the 1 kV voltage sources represented by the voltage curve 484 corresponding to the voltage associated with the different active stages, and using the variable voltage for fine tuning, represented by the voltage curve 486. It should be noted that the values of the constant voltage sources does not need to be the same for all of stages or bridges (e.g., 400 V instead of 1 kV), but are known. In various embodiments, the voltages are either the same or within a small deviation of each other.

When multiple Vm units are used in the circuit, such as the example illustrated in FIG. 16, then the described control will be used to regulate each voltage in a sequential fashion. For example, the first acquisition of the desired voltage Dv will be used to regulated the voltage produced by Vm1 while the unit Vm2 is bypassed by keeping 3*a* and 4*a* closed and 1*a* and 2*a* open, then the second acquisition of the desired voltage will be used to regulate Vm2 while the unit Vm1 is bypassed by closing the switches 3 and 4 and opening the switch 1 and 2, then the unit Vm1 is used again for the third acquisition of the desired voltage Dv, etc., until all the acquisitions are executed. For some applications, the voltage on the Vm units can be set before being applied in such a fashion such that the proper value will be applied instantaneously upon switching the switches 1, 2, 3, and 4 (or 1*a*, 2*a*, 3*a*, and 4*a*). This operation enables a fast switching between two random different values.

Figure 22:
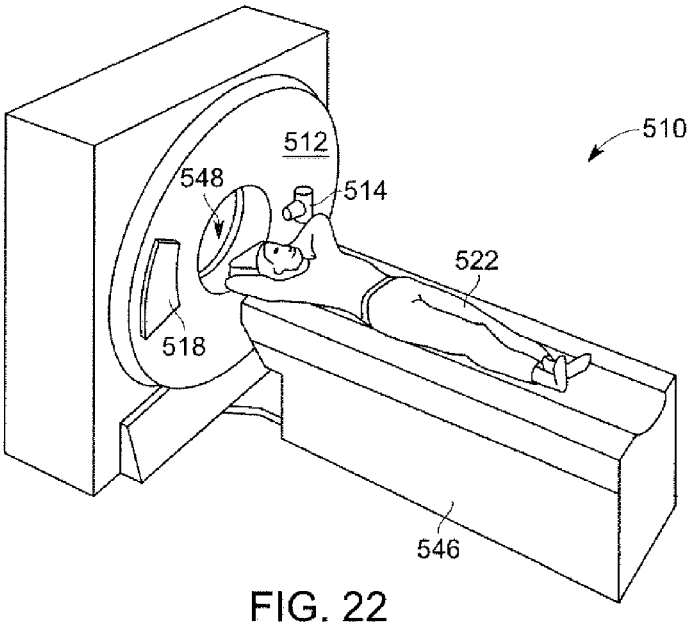
FIG. 22 is a pictorial view of a computed tomography (CT) imaging system in accordance with various embodiments.
Figure 23:
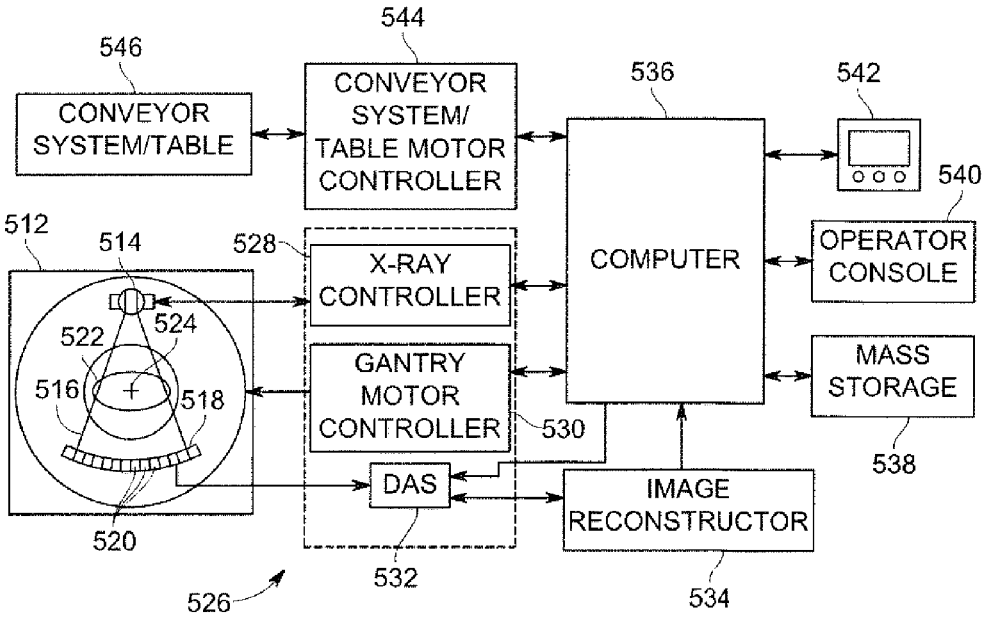
FIG. 23 is a block schematic diagram of the CT imaging system of FIG. 17 in accordance with various embodiments.

Various embodiments may be used to provide voltage control in different applications, for example, for an x-ray assembly, such as the x-ray tube assembly 100, which may be used in conjunction with a computed tomography (CT) system. FIG. 22 provides a pictorial view of a computed tomography (CT) imaging system 510 in accordance with an embodiment, and FIG. 23 provides a block schematic diagram of the CT imaging system 510 of FIG. 22 in accordance with various embodiments. The CT imaging system 510 includes a gantry 512. The gantry 512 has an x-ray source 514 configured to project a beam of x-rays 516 toward a detector array 518 positioned opposite the x-ray source 514 on the gantry 512. The x-ray source 514 may include an x-ray tube assembly such as the x-ray tube assembly 100. In some embodiments, the gantry 512 may have multiple x-ray sources (e.g., along a patient theta or patient Z axis) that project beams of x-rays. The detector array 518 is formed by a plurality of detectors 520 which together sense the projected X-rays that pass through an object to be imaged, such as a medical patient 522. During a scan to acquire x-ray projection data, the gantry 512 and the components mounted thereon rotate about a center of rotation 524. While the CT imaging system 510 is described in connection with FIG. 22 with reference to the medical patient 522, it should be noted that the CT imaging system 510 may have applications outside of the medical realm. For example, the CT imaging system may 510 may be utilized for ascertaining the contents of closed articles, such as luggage, packages, etc., and in search of contraband such as explosives and/or bio-hazardous materials.

Rotation of the gantry 512 and the operation of the x-ray source 514 are governed by a control mechanism 526 of the CT system 510. The control mechanism 526 includes an x-ray controller 528 that provides power and timing signals to the x-ray source 514 (which may include generating control signals in accordance with various embodiments) and a gantry motor controller 530 that controls the rotational speed and position of the gantry 512. A data acquisition system (DAS) 532 in the control mechanism 526 samples analog data from the detectors 520 and converts the data to digital signals for subsequent processing. An image reconstructor 534 receives sampled and digitized x-ray data from the DAS 532 and performs high-speed reconstruction. The reconstructed image is applied as an input to a computer 536, which stores the image in a mass storage device 538.

Moreover, the computer 536 may also receive commands and scanning parameters from an operator via operator console 540 that may have an input device such as a keyboard (not shown in FIGS. 22 and 23). An associated display 542 allows the operator to observe the reconstructed image and other data from the computer 536. Commands and parameters supplied by the operator or as describe herein are used by the computer 536 to provide control and signal information to the DAS 532, the x-ray controller 528, and the gantry motor controller 530. For example, in various embodiments as described herein, the Vm1 capacitor is initially active in the loop (switched into the loop as described herein) and the voltage on the Vm2 capacitor is changed during this time period. Then only the capacitor Vm2 is switched into the loop using the switching arrangements as described herein and the voltage on the capacitor Vm1 is changed during this time period. This process is repeated from the initial step with potentially different voltage levels. Thus, this mode of operation may provide a stable output voltage during one image view of the CT imaging system 510 and then rapidly switch to a different output voltage before the next image view.

Additionally, the computer 536 may operate a table motor controller 544, which controls a motorized table 546 to position the patient 522 and/or the gantry 512. For example, the table 546 may move portions of the patient 522 through a gantry opening 548. It may be noted that in certain embodiments, the computer 536 may operate a conveyor system controller 544, which controls a conveyor system 546 to position an object, such as baggage or luggage, and the gantry 512. For example, the conveyor system 546 may move the object through the gantry opening 548.

It should be noted that the various embodiments may be implemented in hardware, software or a combination thereof. The various embodiments and/or components, for example, the modules, or components and controllers therein, also may be implemented as part of one or more computers or processors. The computer or processor may include a computing device, an input device, a display unit and an interface, for example, for accessing the Internet. The computer or processor may include a microprocessor. The microprocessor may be connected to a communication bus. The computer or processor may also include a memory. The memory may include Random Access Memory (RAM) and Read Only Memory (ROM). The computer or processor further may include a storage device, which may be a hard disk drive or a removable storage drive such as a solid state drive, optical drive, and the like. The storage device may also be other similar means for loading computer programs or other instructions into the computer or processor.

As used herein, the term "computer", "controller", and "module" may each include any processor-based or microprocessor-based system including systems using microcontrollers, reduced instruction set computers (RISC), application specific integrated circuits (ASICs), logic circuits, GPUs, FPGAs, and any other circuit or processor capable of executing the functions described herein. The above examples are exemplary only, and are thus not intended to limit in any way the definition and/or meaning of the term "module" or "computer."

The computer, module, or processor executes a set of instructions that are stored in one or more storage elements, in order to process input data. The storage elements may also store data or other information as desired or needed. The storage element may be in the form of an information source or a physical memory element within a processing machine.

The set of instructions may include various commands that instruct the computer, module, or processor as a processing machine to perform specific operations such as the methods and processes of the various embodiments described and/or illustrated herein. The set of instructions may be in the form of a software program. The software may be in various forms such as system software or application software and which may be embodied as a tangible and non-transitory computer readable medium. Further, the software may be in the form of a collection of separate programs or modules, a program module within a larger program or a portion of a program module. The software also may include modular programming in the form of object-oriented programming. The processing of input data by the processing machine may be in response to operator commands, or in response to results of previous processing, or in response to a request made by another processing machine.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program. The individual components of the various embodiments may be virtualized and hosted by a cloud type computational environment, for example to allow for dynamic allocation of computational power, without requiring the user concerning the location, configuration, and/or specific hardware of the computer system.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from their scope. While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments, and also to enable any person skilled in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

What is claimed is:

1. A system for controlling an electron beam in an x-ray source, the system comprising:

at least one of (i) a first switching unit having a voltage source and a pair of switches connected in series and configured to switch between open and closed positions to change an output voltage to one of engage or bypass the voltage source, or (ii) a second switching unit having a voltage source, and a first pair of switches connected in series and a second pair of switches connected in series, the first and second pair of switches connected in parallel, and wherein the first and second pairs of switches are configured to switch between open and closed positions to engage or bypass the voltage source to an output voltage; and at least one of a third switching unit having an amplitude controllable voltage source with controllable amplitude, a first pair of switches connected in series and a second pair of switches connected in series, wherein the first and second pair of switches are connected in parallel, and wherein the first and second pairs of switches are configured to switch between open and closed positions to engage the amplitude controllable voltage source with as a positive voltage, a negative voltage or to bypass the amplitude controllable voltage source, wherein the first, second, and third switching units are connected in series and the output voltages generated by the first, second and third switching units define a voltage profile for controlling an electron beam in an x-ray source.

2. The system of claim 1, further comprising a plurality of first switching units connected to a single third switching unit.

3. The system of claim 1, wherein the voltage source for the first and second switching units is a fixed voltage source.

4. The system of claim 3, wherein the voltage source for the at least one first switching unit and the voltage source for the at least one second switching unit have a same operating voltage value.

5. The system of claim 3, wherein the voltage source for the at least one first switching unit and the voltage source for the at least one second switching unit have a different operating voltage value.

6. The system of claim 1, wherein the voltage source for the third switching unit is a non-discretely varying voltage source.

7. The system of claim 1, wherein the voltage source for the first switching unit is a fixed 1 kilo-volt (kV) source and the voltage source for the third switching unit is a varying up to at least 500 volt (V) source.

8. The system of claim 1, wherein the voltage profile is shaped to control one of an extraction electrode or focusing electrode of an x-ray tube, and the voltage of the voltage profile is adjustable between about −3 kilo-volts (kV) and about 12 kV.

9. The system of claim 1, further comprising a Pierce-type cathode x-ray tube and the voltage profile is generated to control at least one of an extraction electrode or focusing electrode of the x-ray tube.

10. The system of claim 1, further comprising four of the first switching units and two of the second switching units.

11. The system of claim 1, wherein the first and second switching units are configured to discretely adjust the voltage level of the voltage profile, the voltage level being both positive and negative.

12. The system of claim 1, wherein the at least one third switching unit is configured to non-discretely adjust the voltage level of the voltage profile.

13. The system of claim 1, further comprising a voltage controller for controlling the voltage source of the at least one first switching unit and the at least one second switching unit.

14. The system of claim 13, wherein the voltage controller is configured to separately control the at least one first switching unit and the at least one second switching unit, and the amplitude controllable voltage source is configured to be controlled by the at least one third switching unit independent to and in parallel with the voltage controller control of the at least one first switching unit and the at least one second switching unit.

15. The system of claim 1, further comprising a plurality of third switching units that are configured to control a corresponding amplitude controllable voltage source, each the amplitude controllable voltage sources having a different maximum voltage charging capacity, and wherein the third switching units independently control the corresponding amplitude controllable voltage source.

16. An x-ray tube assembly comprising:

an emitter configured to emit an electron beam toward a target;

at least one of an emitter focusing electrode disposed proximate the emitter or an extraction electrode disposed proximate the emitter focusing electrode; and a controller configured to control a voltage supplied to at least one of the emitter focusing electrode and the extraction electrode, the controller including at least one of a (i) first switching unit configured to discretely switch between a common voltage and a positive reference voltage, or (ii) a second switching unit configured to discretely switch between a common voltage, a positive reference voltage and a negative reference voltage, the controller further including a third switching unit having an amplitude controllable voltage source with controllable amplitude, wherein output voltages generated by the first, second and third switching units define a voltage profile for controlling the voltage.

17. The x-ray tube assembly of claim 16, wherein the at least one third switching unit is configured to non-discretely switch an output voltage.

18. The x-ray tube assembly of claim 16, wherein the at least one first switching unit includes a pair of switches connected in series and configured to switch between open and closed positions to change an output voltage, and the at least one second switching unit includes a first pair of switches connected in series and a second pair of switches connected in series, the first and second pair of switches connected in parallel, and wherein the first and second pairs of switches are configured to switch between open and closed position to change and output voltage.

19. The x-ray tube assembly of claim 16, wherein the controller further comprises a plurality of first switching units connected to a single third switching unit.

20. The x-ray tube assembly of claim 16, wherein a voltage source for the first switching unit is a fixed 1 kilo-volt (kV) source and a voltage source for the second switching unit is a varying 500 volt (V) source.

21. The x-ray tube assembly of claim 16, wherein the voltage of the voltage profile is adjustable between about −2.5 kilo-volts (kV) and about 6.5 kV.

22. The x-ray tube assembly of claim 16, wherein the controller further comprises four of the first switching units and two of the second switching units.

23. A method for controlling an x-ray tube, the method comprising:

connecting a plurality of switching units to a form a multi-stage controller, wherein the plurality of switching units include at least one discretely switched unit switching between one of a common voltage and at least one of a positive reference voltage or a negative reference voltage, and further including at least one amplitude-controllable unit switching controllable within a voltage range;

selectively controlling switches of the plurality of switching units to generate a varying voltage output profile including at least one of positive or negative voltage levels; and applying the varying voltage output profile to one or more electrodes of an x-ray tube.

24. The method of claim 23, further comprising discretely changing between a plurality of voltages in the voltage output profile.

25. The method of claim 23, further comprising using a smoothly varying voltage in one of the plurality of switching units.

26. The method of claim 23, wherein the at least one amplitude-controllable unit comprises a capacitor connected to a switch, and further comprising using a measured voltage and a desired voltage to calculate an additional energy to charge the capacitor, the calculated additional energy determining a number of control pulses to apply to the switch of the amplitude-controllable unit to open and close the switch to increase a charge level of the capacitor.

27. The method of claim 23, wherein the at least one amplitude-controllable unit comprises a capacitor connected to a switch, and further comprising using a measured voltage and a desired voltage to calculate a percentage to discharge the capacitor, the calculated percentage determining a duration to close the switch of the amplitude-controllable unit to decrease a charge level of the capacitor.

* * * * *